US006599095B1

(12) United States Patent
Takada et al.

(10) Patent No.: US 6,599,095 B1
(45) Date of Patent: Jul. 29, 2003

(54) PUMP-OFF CONTROL METHOD OF PUMP JACK

(75) Inventors: Noriyuki Takada, Fukuoka (JP); Takayuki Yamakawa, Fukuoka (JP); Hidetoshi Ryu, Fukuoka (JP); Tetsuo Kawano, Fukuoka (JP); Koji Kawamoto, Fukuoka (JP); Toshio Miyano, Fukuoka (JP); Richard L. Pratt, Ohio, OH (US); Brian Mackinnon, Alberta (CA)

(73) Assignee: Kabushiki Kaisha Yaskawa Denki, Fukuoka (JP)

( * ) Notice: Subject to any disclaimer, the term of this patent is extended or adjusted under 35 U.S.C. 154(b) by 0 days.

(21) Appl. No.: 09/959,515

(22) PCT Filed: Apr. 28, 1999

(86) PCT No.: PCT/JP99/02264

§ 371 (c)(1),
(2), (4) Date: Oct. 29, 2001

(87) PCT Pub. No.: WO00/66892

PCT Pub. Date: Nov. 9, 2000

(51) Int. Cl.[7] ..... F04B 19/24; F04B 49/06; F04B 49/00

(52) U.S. Cl. ..... 417/53; 417/44.11; 417/45; 417/42

(58) Field of Search ..... 417/44.11, 45, 417/42, 53

(56) References Cited

U.S. PATENT DOCUMENTS 4,102,394 A 7/1978 Botts
4,145,161 A * 3/1979 Skinner ..... 417/22
4,363,605 A * 12/1982 Mills ..... 417/44.11
4,390,321 A * 6/1983 Langlois et al. ..... 417/15
4,508,487 A * 4/1985 Taylor et al. ..... 417/12
4,691,155 A * 9/1987 Taylor et al. ..... 318/771
5,577,890 A * 11/1996 Nielsen et al. ..... 417/44.2

FOREIGN PATENT DOCUMENTS

JP 57-124081 A 8/1982
JP 61-109483 A 5/1986

* cited by examiner

*Primary Examiner*—Charles G. Freay
*Assistant Examiner*—Timothy P. Solak
(74) *Attorney, Agent, or Firm*—Sughrue Mion, PLLC

(57) ABSTRACT

A pump off control method comprises detecting the speed of the induction motor and an instantaneous value of secondary current of the induction motor. Down stroke time in every cycle of the pump jack is detected. An average value of instantaneous values of the secondary current of the induction motor in the down stroke time in said every cycle is calculated. An average value reference of the secondary current of the induction motor to be compared with calculated average value of the instantaneous values of the secondary current of the induction motor is set. The calculated average value of the instantaneous values of the secondary current is compared with the average value reference after the down stroke end in each cycle. An occurence of pump off is detected if the calculated average value of the instantaneous values is greater than the average value reference.

9 Claims, 16 Drawing Sheets

FIG. 7

| | 25% SPEED | | 50% SPEED | | 100% SPEED | |
|---|---|---|---|---|---|---|
| | $I_{2RMS}$ | $I_{2AV}$ | $I_{2RMS}$ | $I_{2AV}$ | $I_{2RMS}$ | $I_{2AV}$ |
| (1) NORMAL OPERATION (VOLUME EFFICIENCY 100%) | 18.80 | 16.20 | 17.21 | 14.27 | 12.96 | 8.17 |
| (2) OPERATION WHEN PUMP-OFF (VOLUME EFFICIENCY 63.7%) | 25.93 | 21.58 | 24.13 | 19.63 | 19.54 | 12.82 |
| (3) CURRENT RATIO = (2)/(1) | 1.38 | 1.33 | 1.40 | 1.38 | 1.51 | 1.57 |

WHEN PUMP-OFF OCCURS

WHEN PUMP-OFF DOES NOT OCCUR (IN NORMAL OPERATION)

PUMP-OFF CONTROL METHOD OF PUMP JACK

TECHNICAL FIELD

This invention relates to pump-off control of a beam pump driven by a pump jack.

BACKGROUND OF THE INVENTION

Pump-off control sensors in beam pumped wells have been developed from downhole fluid level or pressure indicators, flow and no-flow sensors, vibration sensors, and motor current sensors to recent sensors adopting modern dynagraph card methods capable of analyzing and recording a rod load.

However, the methods of applying the sensors in related arts involve an accuracy problem and are scarcely put to practical use.

Even if the modern dynagraph card methods meet the accuracy, they require a sensor for detecting a sucker rod load, its detection signal processor, etc., and have disadvantages of complicacy and expensiveness as a result.

Since a drive motor is induction motor drive unable to adjust speed, motor stop control must be adopted as control after pump off is detected. Thus, it is feared that a pump may be stopped because of a temporary pump-off factor such as free gas in an oil well, resulting in lowering of the production amount in the oil cell.

To avoid this, so-called on-off operation control of stopping a pump motor when pump off is detected three to five or more successive times and again starting the pump after the expiration of a given time has been adopted.

However, this method places excessive mechanical and electrical stresses on the pump unit and the motor by the on-off operation and has disadvantages of fastening wear of facilities and increasing maintenance costs.

DISCLOSURE OF THE INVENTION

The invention provides the means for solving problems as described above and a pump off control method according to a first embodiment of the invention is as claimed in claims 1 to 4.

According to the pump off control method, without using an expensive dynagraph card system in the related art made up of a rod load sensor and a microcomputer, pump off control software is built in an inverter used for speed control of a pump jack, whereby pump off can be detected not only at low cost, but also precisely.

In addition, since the pump jack speed is controlled, as pump off is detected, the pump jack speed can be lowered to a state in which no pump off exists, whereby continuous production in an oil well can be executed without imposing excessive load on a downhole pump or a sucker rod system. That is, the effects of enhancing the productivity in an oil and improving safety of the facilities can be produced as compared with an oil well to which the pump jack in the related art driven at constant speed is applied.

The maximum speed of the downhole pump can be preset corresponding to change in oil well circumstances accompanying the comparatively long time passage such as an increase in free gas or lowering of the oil well level, so that it is made possible to lower the possibility that pump off will occur, contributing to stable operation in an oil well accordingly.

A pump off control method according to a second embodiment of the invention is as claimed in claims 5 to 8.

That is, the speed of an induction motor for driving a pump jack can be controlled by an inverter of a variable voltage variable frequency power supply and means for detecting the speed of the motor and the instantaneous value of the secondary current of the motor, means for detecting the elapsed time from the reference point at which the secondary current instantaneous value reaches the maximum value, which will be referred to as secondary current maximum value time in the invention, and each down stroke time of the pump jack, means for detecting and storing each secondary current maximum value time, and means for setting reference of the elapsed time at which the secondary current instantaneous value from the reference point reaches the maximum value, which will be referred to as setup reference time in the invention, for comparison with the detected storage value are placed.

When the secondary current maximum value time becomes longer than the setup reference time, it is detected as occurrence of a pump off condition and if pump off occurs, the motor speed is lowered gradually in sequence. In contrast, when the secondary current maximum value time is shorter than or equal to the setup reference time, it is detected as reset of pump off and the motor speed is controlled so as to recover the lowered speed in sequence, whereby overpressuring of the downhole pump is prevented and high production of crude oil is enabled in response to the circumstances of an oil well.

According to the invention, without using an expensive dynagraph card system made up of a rod load sensor and a microcomputer, pump off control software is incorporated in a vector control inverter used for speed control of a pump jack, thus pump off can be detected not only at low cost, but also precisely for the reason described later. In addition, since the pump jack speed is controlled, as pump off is detected, the pump jack speed can be lowered to a state in which no pump off exists, so that continuous production in an oil well can be executed without imposing excessive load on a downhole pump or a sucker rod system.

That is, the effects of enhancing the productivity in an oil and improving safety of the facilities can be produced as compared with an oil well to which the pump jack in the related art driven at constant speed is applied. The maximum speed of the downhole pump can be preset corresponding to change in oil well circumstances accompanying the comparatively long time passage such as an increase in free gas or lowering of the oil well level, so that it is made possible to lower the possibility that pump off will occur, contributing to stable operation in an oil well accordingly.

As compared with the described method of calculating the effective value or the average value of the secondary current instantaneous value of the motor in down stroke, comparing the value with the reference value, and detecting pump off in the first embodiment, it is not necessary to change the setup reference value as the pump jack speed is changed.

The method, which is based on detection of the differenced between the secondary current maximum value time and the setup reference time, is not related to the magnitude of the secondary current and thus has an excellent feature that it is hard to be affected by variations in the downhole pump load caused by change in the content of water and impurities in crude oil, and it is made possible to precisely detect pump off accordingly.

In addition, operation processing becomes simple as compared with the method of the first embodiment, thus the method of the second embodiment has the advantage that a controller can be configured easily.

BRIEF DESCRIPTION OF THE DRAWINGS

First and second embodiments of the invention will be discussed according to FIGS. 1 to 16.

BEST MODE FOR CARRYING OUT THE INVENTION

A first embodiment of the invention will be discussed with reference to FIGS. 1 to 9.

A second embodiment of the invention will be discussed with reference to FIGS. 1 and 10 to 16.

Figure 1:
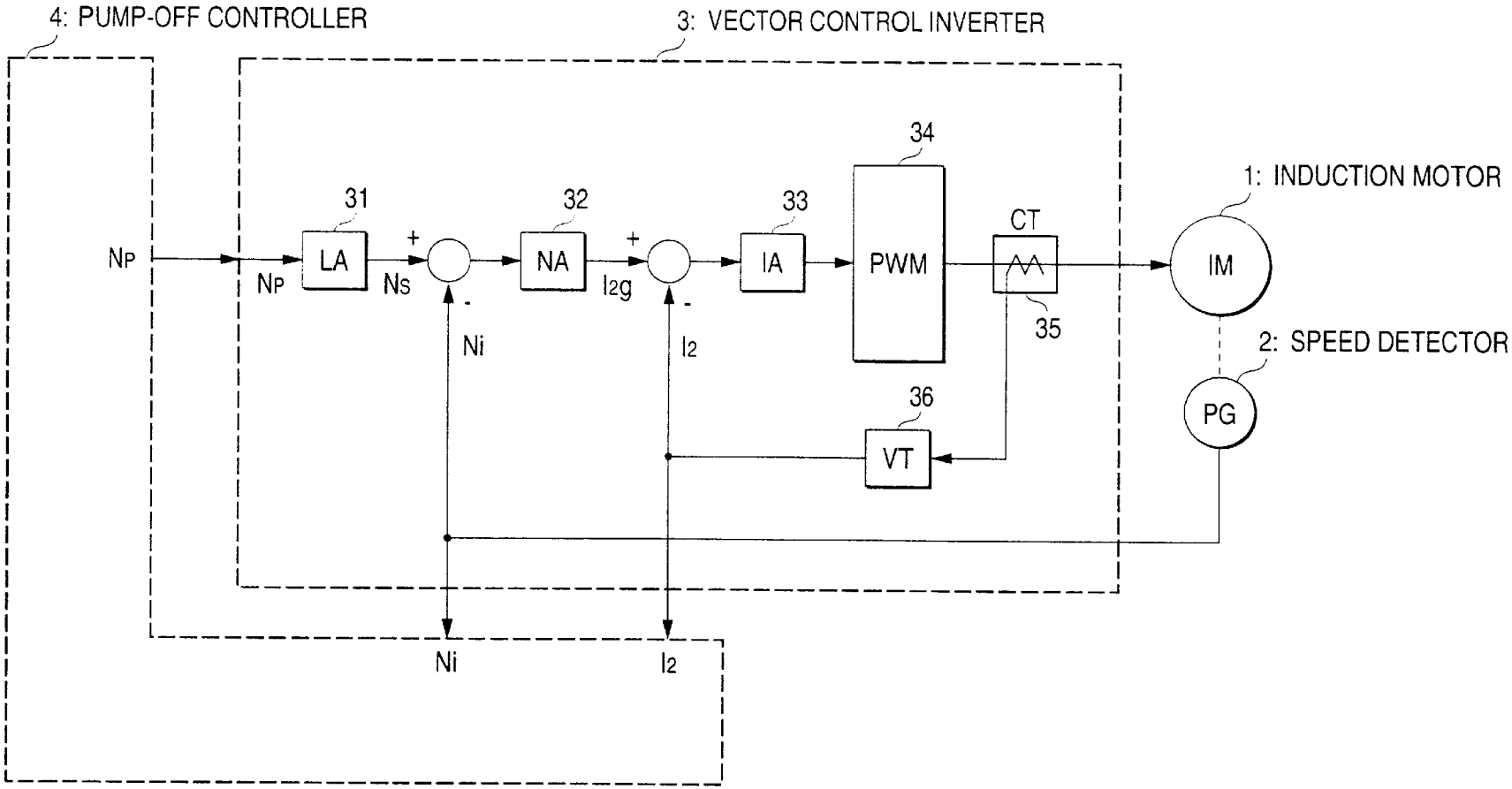
FIG. 1 shows a configuration example of the invention incorporating a vector control inverter for easily getting an instantaneous value of secondary current because it is necessary to perform reliable speed control of a drive motor of a pump jack and detect the instantaneous value of the secondary current of the motor for detecting pump off.
Figure 2:
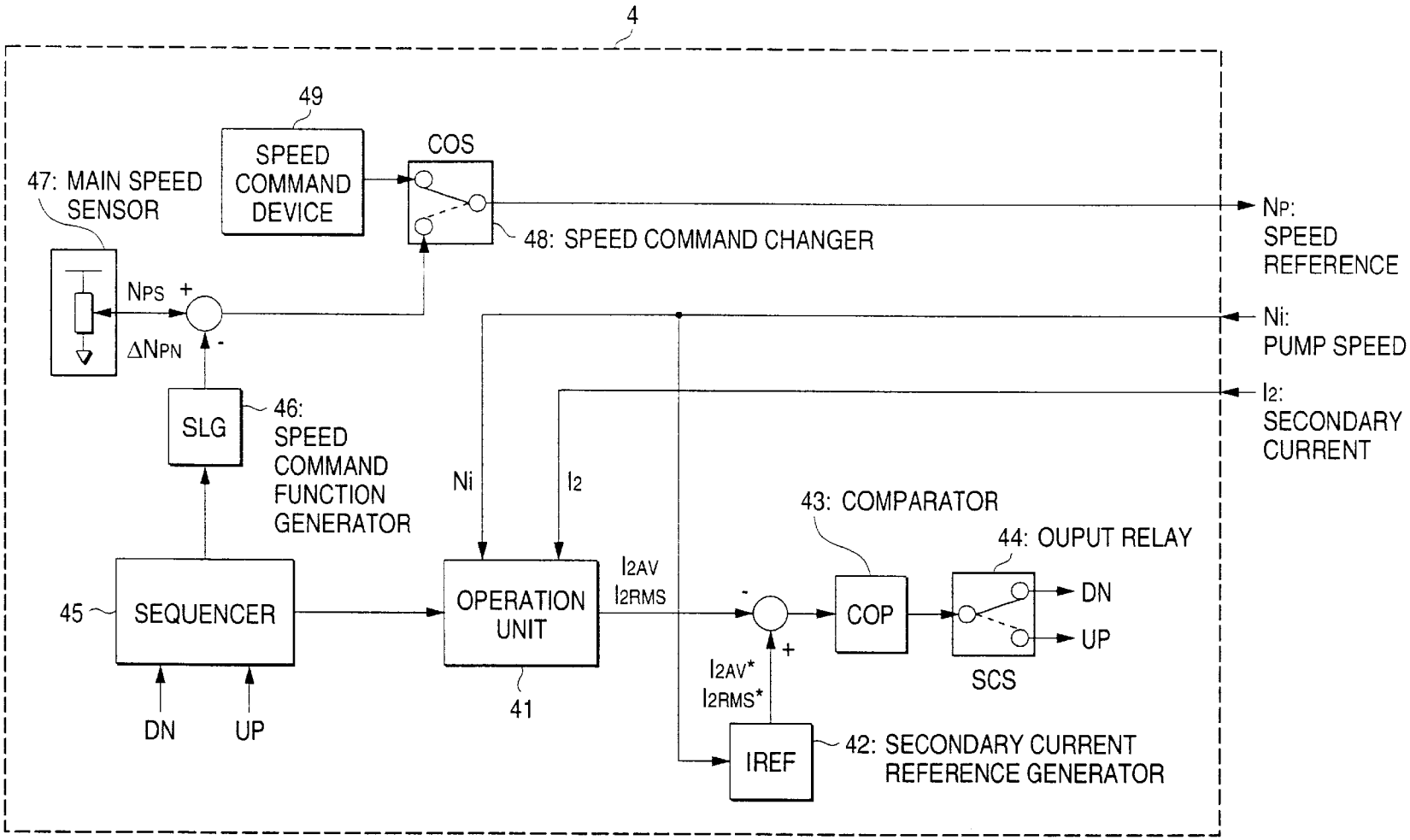
FIG. 2 is a block diagram to show the detailed configuration of a pump-off controller in FIG. 1.

FIG. 1 is a drawing to show embodiments of pump-off control methods according to the invention incorporating a vector control inverter for easily outputting an instantaneous value of secondary current, and FIG. 2 is a block diagram to show the configuration of a pump-off controller.

In FIG. 1, numeral 1 denotes an induction motor for driving a pump jack, numeral 2 denotes a speed detector being connected directly to the induction motor 1 for detecting the speed of the induction motor 1, numeral 3 is a known vector control inverter having a current minor loop, and numeral 4 denotes a pump-off controller.

The vector control inverter 3 comprises a linear accelerator 31, a speed regulator 32, a current regulator 33, a PWM controller 34, a current transformer 35, and a vector operation section 36. The linear accelerator 31 converts Np, output of the pump-off controller 4, into speed reference of the induction motor 1, Ns at the acceleration rate which is set inside. The speed reference Ns is compared with actual speed Ni detected by the speed detector 2 and a deviation therebetween is amplified by the speed regulator 32, then a secondary current reference $I_{2g}$ is output.

Motor current is detected by the current transformer 35 and only the secondary current component of the motor current is detected as $I_2$ by the vector operation section 36, then is compared with the secondary current reference $I_{2g}$. A deviation therebetween is amplified by the current regulator 33 and the pulse width of voltage is adjusted by the PWM controller 34, then secondary current required for driving a load is supplied to the induction motor 1. Thus, the vector control inverter 3 automatically regulates the motor speed so that the actual speed Ni becomes almost equal to the speed reference Np. In the figure, a control circuit of the flux component current of the induction motor 1 required for vector control is not shown for simplicity because it is well known and is not directly related to the pump-off control of the invention.

The pump-off controller 4 comprises an operation device 41, a secondary current reference generator 42, a comparator 43, an output relay 44, a sequencer 45, a speed reference function generator 46, a main speed reference 47 of pump jack, a speed reference changer 48, and a speed reference 49, as shown in FIG. 2. The operation device 41 has functions of calculating and storing the effective value and average value of the instantaneous value of secondary current with respect to each down stroke time of the pump jack, and detects $I_{2RMS}$, $I_{2AV}$ corresponding to the actual speed Ni of the induction motor 1 by a method described later. The secondary current reference generator 42 sets average value reference $I_{2AV}^*$ or effective value reference $I_{2RMS}^*$ of the secondary current when no pump off occurs, namely, during the normal operation, and regulates the setup value in response to the actual speed Ni of the pump jack.

The average value $I_{2AV}$ or effective value $I_{2RMS}$ of the instantaneous value of secondary current actually detected is compared with the setup value $I_{2AV}^*$ or $I_{2RMS}^*$ by the comparator 43.

If $I_{2AV}>I_{2AV}^*$ or $I_{2RMS}>I_{2RMS}^*$, the output relay is switched to a DN position.

In contrast, if $I_{2AV}\leqq I_{2AV}^*$ or $I_{2RMS}\leqq I_{2RMS}^*$ the output relay is switched to an UP position.

Here, when $I_{2AV}>I_{2AV}^*$ or $I_{2RMS}>I_{2RMS}^*$, it means that occurrence of pump off is detected as described later;

when $I_{2AV}\leqq I_{2AV}^*$ or $I_{2RMS}\leqq I_{2RMS}^*$ it means that reset of pump off is detected.

The sequencer 45 has a function of controlling a pump off sequence and a function of issuing a speed reference for speeding down or up the speed of the pump jack in response to occurrence or reset of pump off. That is, DN or UP signal of the output relay 44 is counted and when the DN signal is detected twice or more successively, for example, a pump off sequence program is started.

When the pump off sequence program is started, the sequencer 45 automatically determines the notch of the speed of the pump jack being operated, and controls the speed command function generator 46 so that the pump jack speed becomes lower than the current speed by one notch. In contrast, if the UP signal is detected twice or more successively, a pump off reset sequence program is started, and the speed command function generator 46 is controlled so that the pump jack speed becomes higher than the current operating speed by one notch contrary to the case of the pump off occurrence described above.

The main speed setter 47 sets the maximum speed corresponding to the current circumstances of the oil well, for example, like $N_{ps}$=100% speed or $N_{ps}$=80% speed.

Therefore, if pump off is detected during the operation at the setup speed, the speed is forcibly lowered by one notch with the speed reference function generator 46. That is, the pump jack speed becomes $N_{ps}-\Delta N_{p1}=N_p$ as $\Delta N_{pn}\rightarrow\Delta N_{p1}$, and a wait is made for the pump off condition to disappear. If pump off is detected successively, the speed is further lowered by one notch, for example, by $\Delta N_{p2}=2\times\Delta N_{p1}$.

However, when $N_{ps}-N_{pn} \leqq 0$, the pump jack is stopped. In this case, a pump stop and control change sequence program in the sequencer 45 starts. The pump stop and control change sequence program stops the pump off program and switches the speed reference changer 48 to the speed reference 49 side.

The speed reference 49 generates a crawling command to make a search for the presence or absence of a pump off condition. Upon completion of the switching, a no pump off searching program in the sequencer 45 starts. It is a control program for again forcibly starting the pump jack stopping with pump off in a given time, operating the pump jack at a crawling, and checking whether or not a pump off condition exists during the crawling operation; the program turns on/off the pump jack crawling operation and stop sequence of the pump jack and the crawling command of the speed reference 49 and checks whether or not pump off exists during the crawling operation.

If pump off reset is detected twice or more successively during the crawling operation, the no pump off searching program switches the speed reference changer 48 to the main speed set $N_{ps}$ side and again starts the pump off control sequence program. Thus, the pump jack is again controlled at the speed of $N_{ps}-\Delta N_{pn}=N_p$ and is automatically speeded up and is restored to the initial setup speed $N_{ps}$ while reset of the pump off condition is checked. As described so far, the pump off controller 4 calculates and stores the average value or effective value of the instantaneous value of the secondary current of the induction motor 1 and compares the average value or effective value with the corresponding reference value, thereby detecting pump off or pump off reset.

Figure 3:
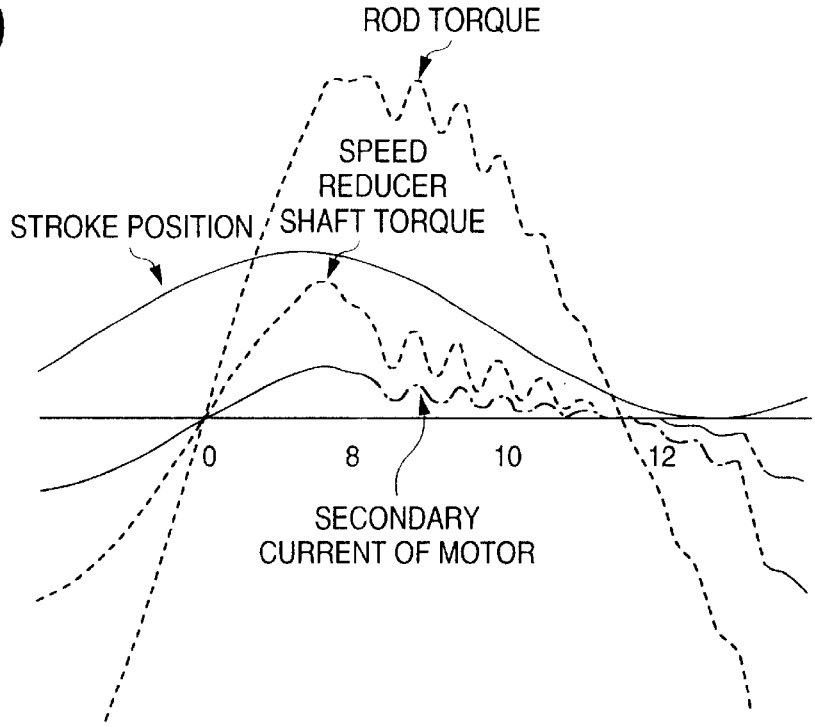
FIGS. 3(*a*)–(*b*), 4–5, 6(*a*)–(*b*), and 7–8 are drawings to describe pump-off detection methods based on the average values and effective values of the instantaneous values of secondary current of an induction motor for each cycle of a pump jack.
Figure 3:
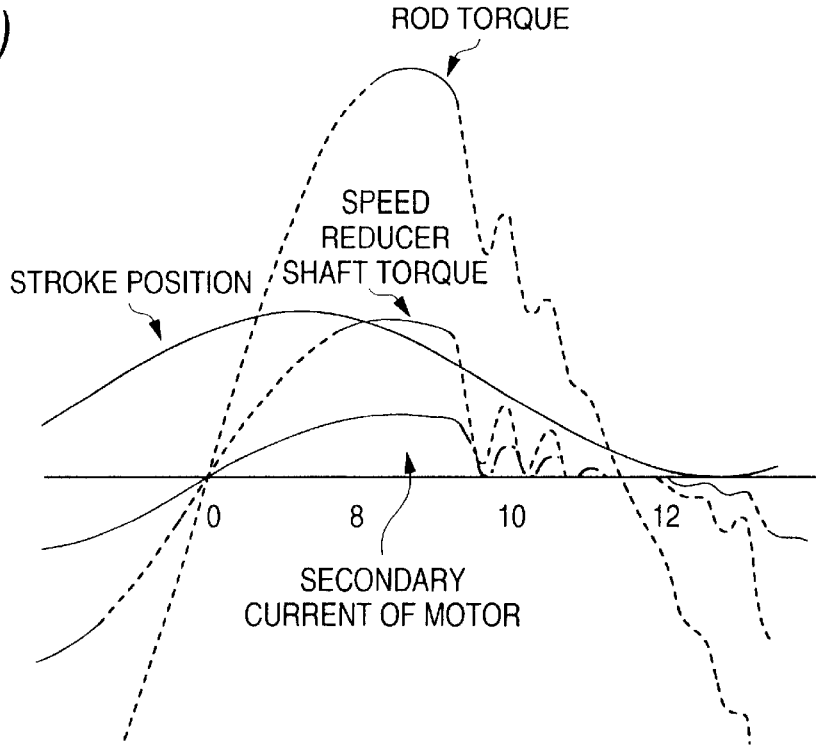

The reason why pump off can be detected by detecting the average value or effective value of the instantaneous value of the secondary current of the induction motor 1 is as follows:

When the rated stroke speed of the pump jack is 11.3 strokes/minute and the used pump unit is APIC114-143-64 pump unit, FIG. 3 shows sucker rod torque, net speed reducer shaft torque, and secondary current of the induction motor 1 found by computer simulation when the pump unit is operated at 50% of the rated speed. The figure also shows pump jack stroke positions.

FIG. 3(*a*) shows the characteristic when pump off does not occur, namely, when the normal operation is performed, and FIG. 3(*b*) shows the characteristic when pump off occurs and the volume efficiency is degraded to 64%. By comparing FIGS. 3(*a*) and 3(*b*), it is seen that the point in time at which the sucker rod torque, the net speed reducer shaft torque, and the secondary current of the induction motor 1 at the down stroke time decreases is delayed when pump off occurs.

Therefore, if an instantaneous value is detected in response to a specific stroke position and is compared with the reference value applied when pump off does not occur and the normal operation is performed, it is made possible to detect pump off. For example, in the embodiment, each position is detected around crank angle 66 deg (crank angle measured with the crank angle of the pump jack when the tip position of the pump jack is the highest position as 0 deg, which will be hereinafter referred to as θ' base angle) is detected and the value of the secondary current of the induction motor 1 at the time is compared with the value of the secondary current when the normal operation is performed, whereby pump off can be detected.

Figure 4:
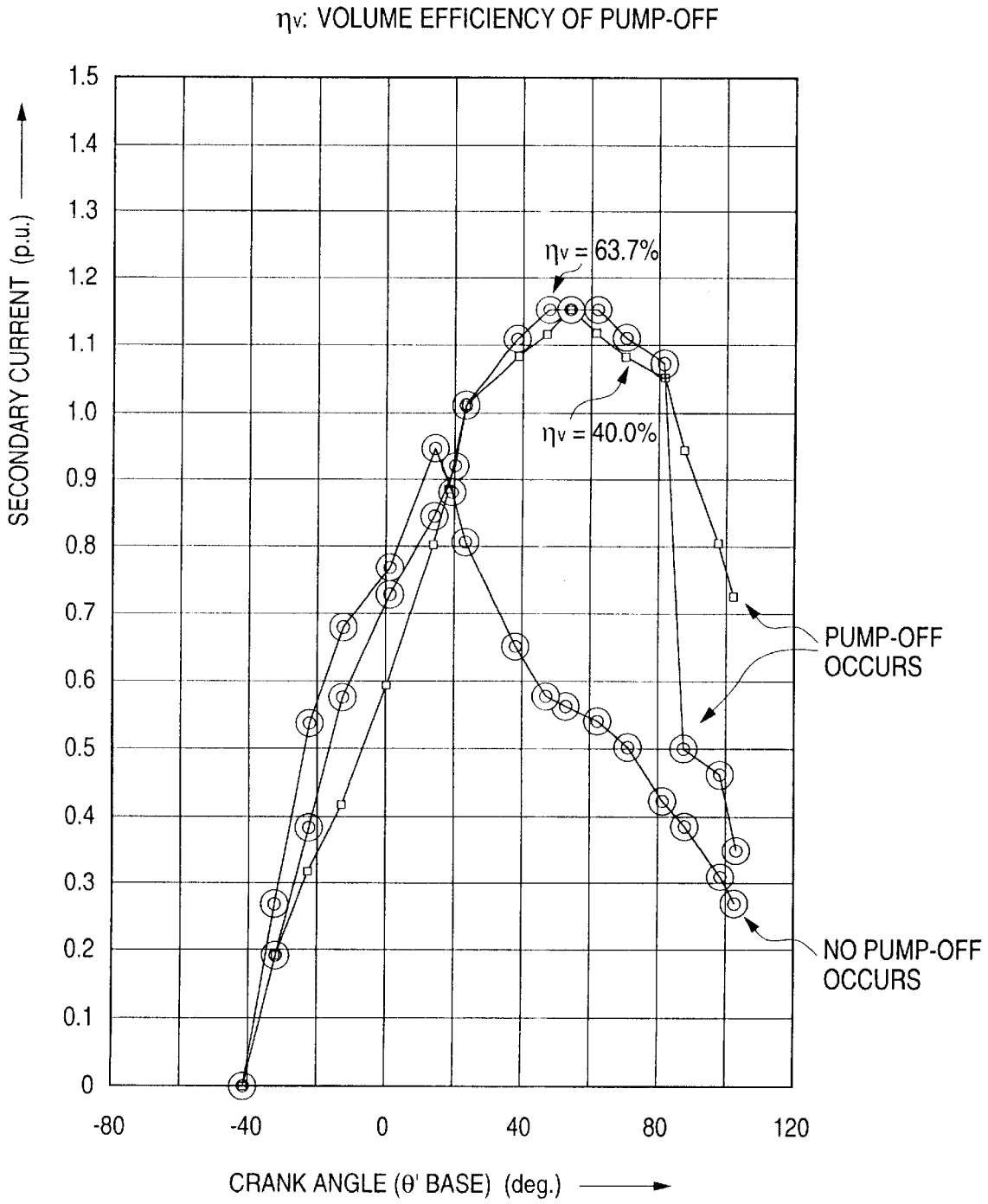

In FIG. 4, a computer simulation analysis is carried out on the same pump jack as described above when pump volume efficiency ηv is 40% and the volume efficiency ηv is 60% with the pump jack stroke speed set to 25%, and the obtained secondary currents of the induction motor 1 are plotted relative to the crank angle (θ' base) As shown here, if the volume efficiency is degraded, occurrence of pump off can be detected by the described method.

However, in the embodiment, as the pump jack speed rises, the obtained secondary current of the induction motor 1 makes a vibration response because of the vibration characteristic of the sucker rod system, and the method of comparing the instantaneous value of the secondary current relative to a specific crank angle with the reference value as described above is difficult to detect pump off reliably.

Figure 5:
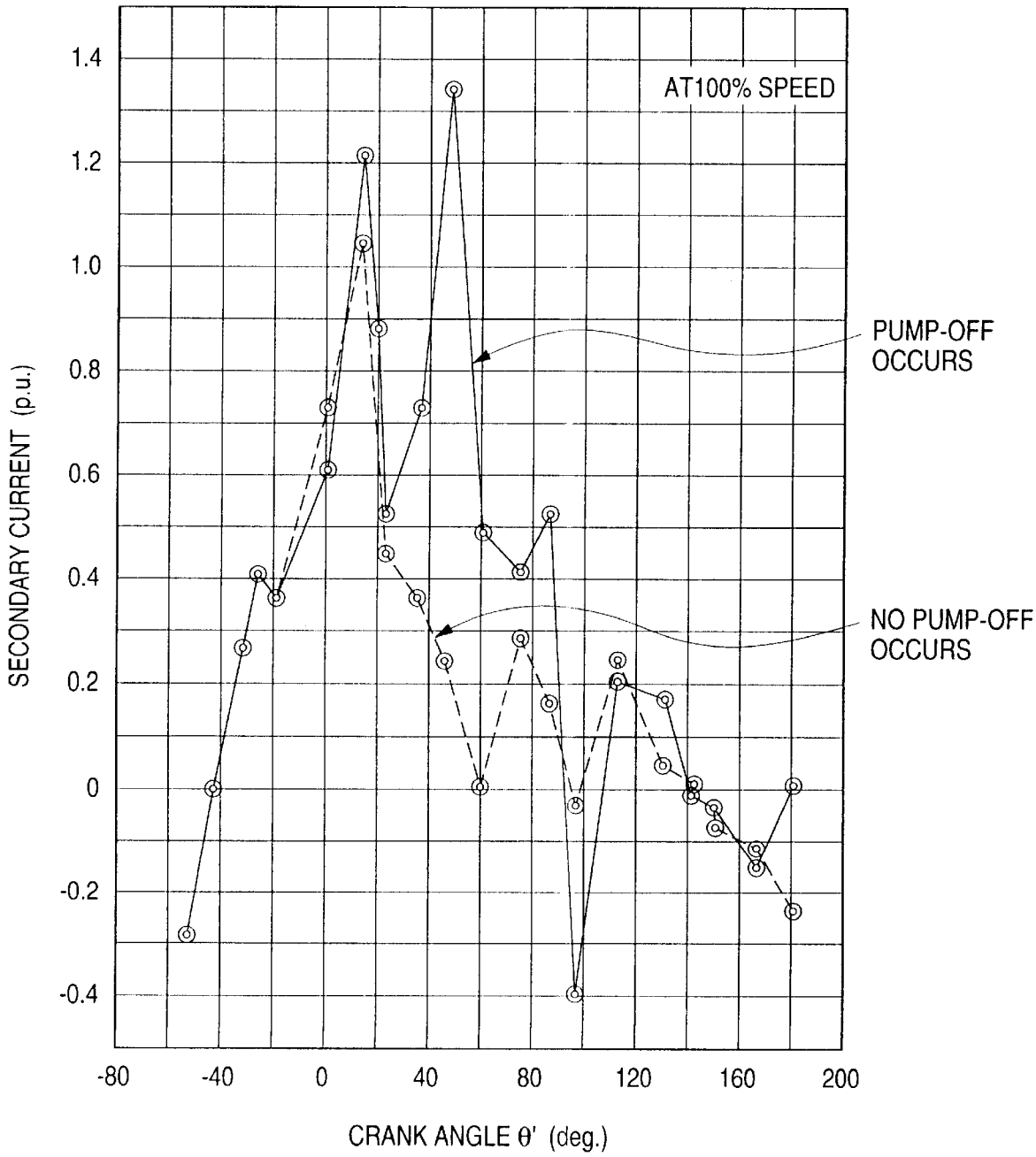

FIG. 5 shows it. In this figure, the results of carrying out a similar computer simulation analysis on the secondary currents of the induction motor 1 when pump off occurs and when the normal operation is performed at 100% stroke speed are plotted relative to the crank angle. As shown here, it is seen that it becomes difficult to detect pump off accurately from comparison between the instantaneous values of the secondary currents around the crank angle 66 deg and the reference values.

In the invention, the problem is solved by the method of calculation and detection of the average value or effective value of the secondary current of the induction motor 1 with respect to the down stroke time (strictly, reference down stroke time as described later) as described above.

Figure 6:
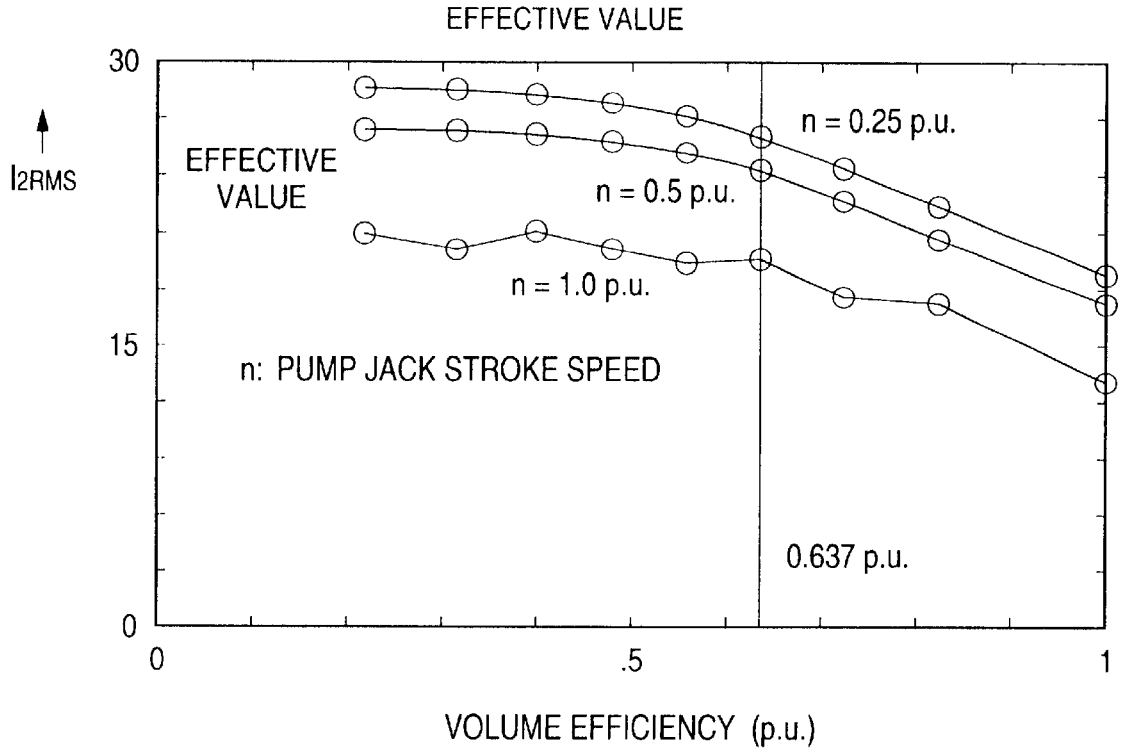
Figure 6:
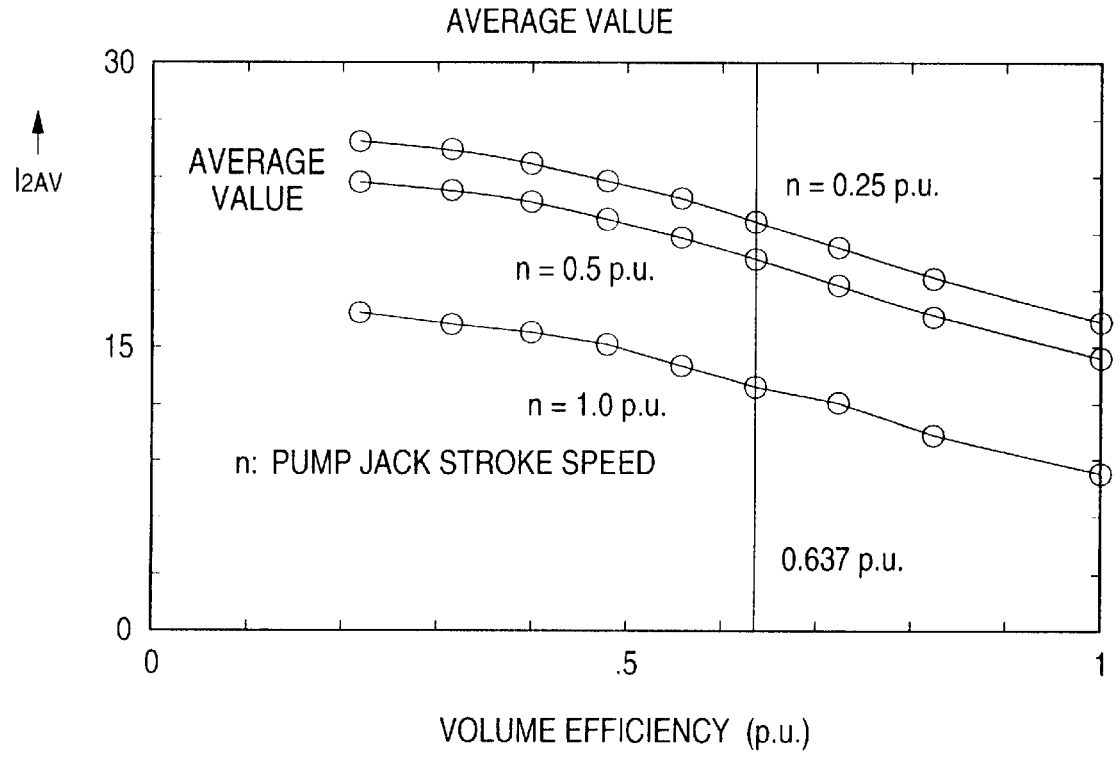

The reason why pump off can be detected based on the average value or effective value of the instantaneous value of the secondary current of the induction motor 1 for each down cycle is as follows:

FIG. 6 shows the average values and effective values of secondary currents of the induction motor 1 at the down stroke time, found by executing a computer analysis; the volume efficiency is taken on the X axis and the secondary currents $I_{2RMS}$ and $I_{2AV}$ of the induction motor 1 are taken on the Y axes and the analysis results at pump jack stroke speeds 1.00 p.u. (100% speed), 0.5 p.u. (50% speed), and 0.25 p.u. (25% speed) are plotted.

When the normal operation is performed with no pump off, the volume efficiency is almost 100% and is gradually degraded as pump off becomes fierce.

Now, assuming that the case where the volume efficiency falls below 63.7% (0.637 p.u.) is detected as occurrence of pump off considering state change in an oil well, the secondary current value in the normal operation with no pump off and the secondary current value when pump off occurs become largely different values as shown in FIG. 7.

Note 1: $I_{2RMS}$: Effective value (A) calculated from instantaneous secondary current at the down stroke time $I_{2AV}$: Average value (A) calculated from instantaneous secondary current at the down stroke time Note 2: Rated secondary current of motor: 36.9 (A)

That is, it is obvious that if the current difference is used, it is made possible to detect pump off accurately by executing digital current difference calculation, for example.

Next, a method of calculating the effective value or average value of the instantaneous value of the secondary current at each down stroke time will be discussed.

This calculation requires the instantaneous value of the secondary current of the induction motor 1, the speed at the time, and measurement start and end time signals. Particularly, how the down stroke start signal of measurement start is detected introduces a problem. Of course, if the pump jack is provided with a mechanical or magnetic sensor for detecting the crank angle zero position for each rotation, the problem can be solved relatively easily. In the invention, however, without such a mechanical or magnetic sensor to simplify the system configuration, attention is focused on the point that the zero point of net speed reducer shaft torque is fixed to a special crank angle determined by the machine constant of the pump jack and thus the zero-cross point of the secondary current of the induction motor 1 is also fixed to the crank angle, and this nature is applied for solving the problem.

Figure 8:
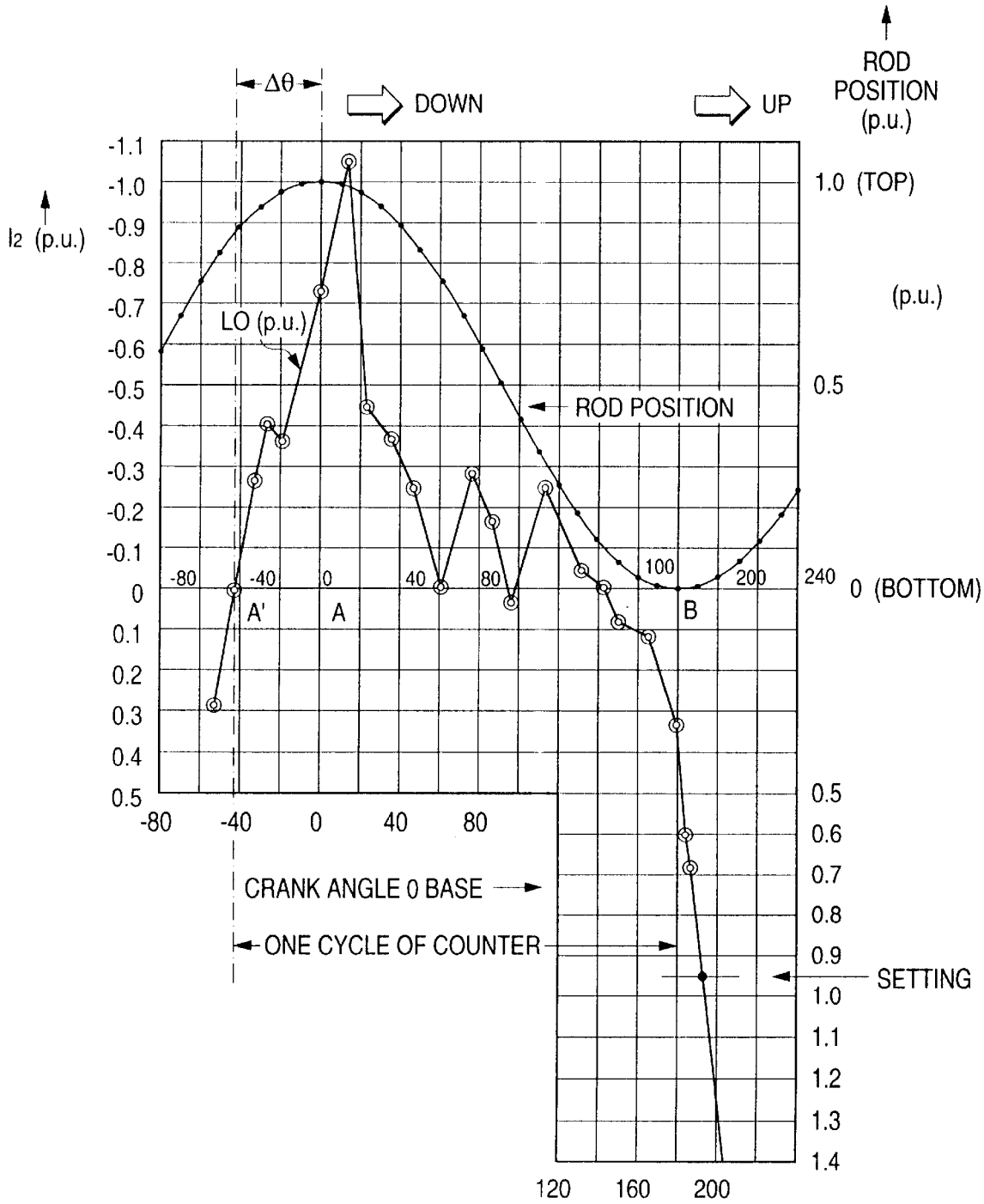

FIG. 8 shows an example wherein the secondary current of the induction motor 1 and rod position when the pump jack operates normally at 100% speed are plotted with respect to the crank angle (θ' base). In the figure, in the invention, the reference down stroke time is found according to the following expression with A' point (second current zero-cross point) to B point as the reference cycle time with respect to the actual down stroke from A point (0 deg) to B point (180 deg):

$$T_E(T_S/2)+(\Delta\theta/V_o)=(1/S)\{30+(\Delta\theta/6.0)\}(\text{sec}) \quad (1)$$

where $T_E$: Reference down stroke time for calculating average value or effective value of secondary current (sec)

$T_S$: Pump jack stroke time=60/S (sec)

S: Pump jack stroke speed (spm)

$V_O$: Average crank rotation speed=360/$T_S$=6.0×S (deg/sec)

Δθ: Phase difference angle between crank angle matching zero-cross point of secondary current and crank angle of up stroke end (deg): (Already known according to machine design specifications of pump jack)

Therefore, if the A' point can be detected for each stoke cycle while the pump jack is operating, the secondary current instantaneous value every minute time At (sec) of secondary current or the square value of the secondary current instantaneous is integrated for $T_E$ seconds from the point in time, whereby effective value or average value can be found according to the following expression:

$$I_{2RMS}=\{\Sigma(I_{2t}^2\times\Delta t)/T_E\}^{1/2}\ (\text{A}) \quad (2)$$

$$I_{2AV}=\Sigma(I_{2t}\times\Delta t)/T_E\ (\text{A}) \quad (3)$$

where $I_{2t}$: Instantaneous value of secondary current at time t (A)

Δt: Minute time for integration operation (sec)

Next, a detection method of the A' point will be discussed.

The A' point is the rod torque zero point before the up stroke end and must be distinguished from the rod torque zero point around the down stroke end. Thus, in the invention, the logical operation on the direction and magnitude of the second current and signals is applied. A description will be given by taking the case of designing the case where the induction motor 1 generates motor side torque as plus of secondary current as an example.

According to the operation of the down stroke side of the pump jack, the induction motor 1 generates a braking torque and the secondary current becomes minus and therefore this is stored. Next, to detect the fact that the pump jack makes a transition to the up stroke side, means for detecting the fact that the actual secondary current becomes 50% or more is provided. Storage of minus secondary current and the fact that the secondary current is 50% or more are carried out at the same time, whereby the fact that the pump jack reliably makes the transition to up stroke from down stroke is detected and stored. Therefore, the zero point when the secondary current makes a transition to zero, minus from plus after the point in time is the A' point and can be easily detected by performing well-known logical operation.

Figure 9:
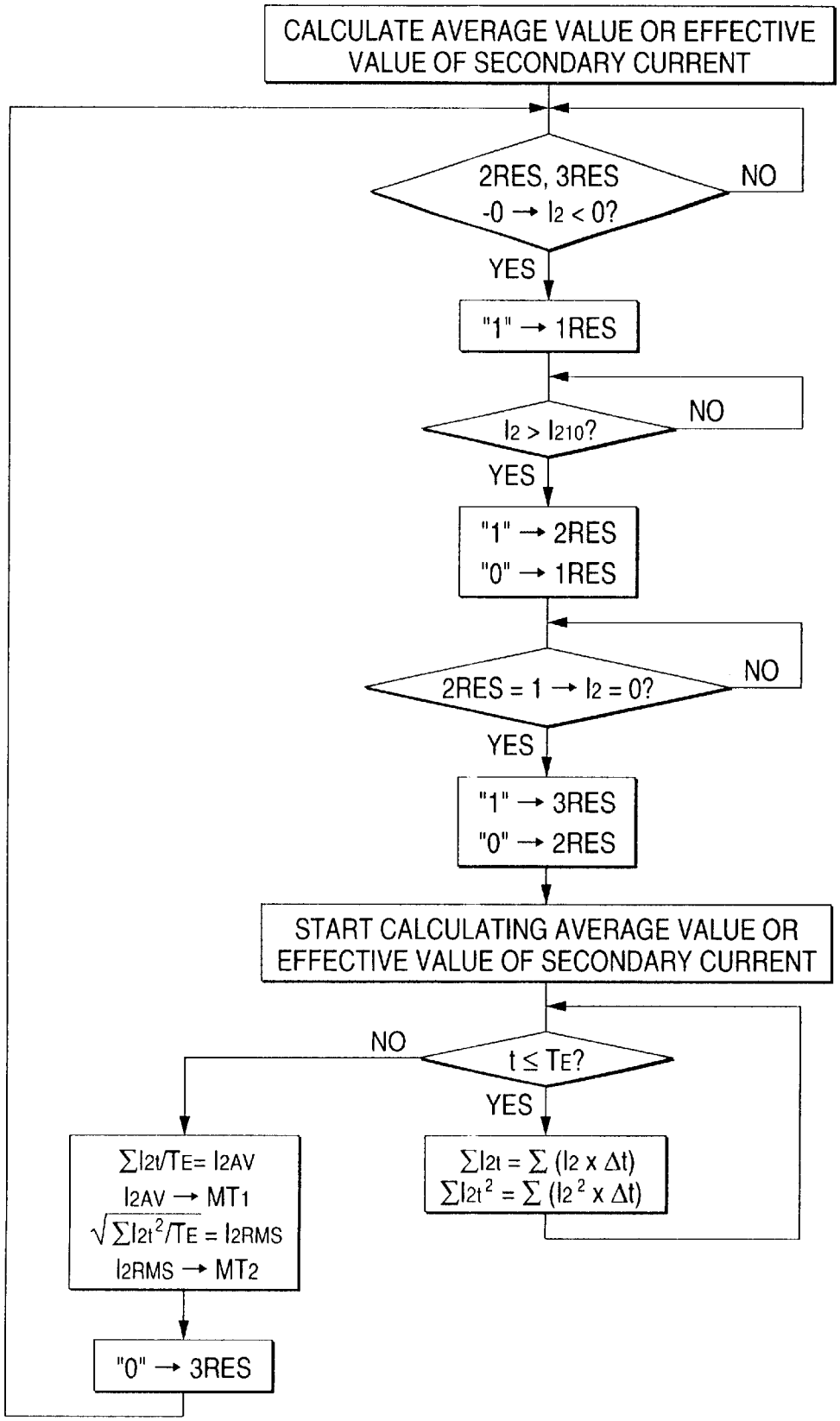
FIG. 9 is a flowchart to show the average value or effective value calculation process of instantaneous value of secondary current.

FIG. 9 shows a calculation flow of the average value or effective value of the instantaneous value of the secondary current described so far for reference. The operation device 41 in FIG. 2 is an operation device having the described operation, storage, and logical control functions.

Next, the fact that the zero-cross point of secondary current is determined by a mechanical constant of a pump jack will be discussed.

The instantaneous value of secondary current is a value directly proportional to net speed reducer shaft torque and the zero-cross point of the secondary current is a point giving zero of the following net speed reducer shaft torque expression:

$$T_L=W_{PR}\cdot TF+L_C\cdot W_{CB}\cdot\cos(d-\theta)=W_{PR}\cdot TF+T_{CB}(kg\text{–}m) \quad (4)$$

where $T_L$: Net speed reducer shaft torque (kg–m)

$W_{PR}$: Polished load (kg)

TF: Pump jack torque factor (m)

$L_C$: Counter balance rotation radius (m)

$W_{CB}$: Counter balance weight (kg)

d: Necessary phase angle matching the angle at which counter balance effect reaches the maximum (deg)

$T_{CB}$: Counter balance torque (kg–m)

TF in expression (4) is determined by the machine constant depending on the link mechanism of the pump jack and the crank rotation angle. For example, with pump unit APIC 456-304-120, TF is zero at 182.1 deg and 366.0 deg. In another example, with APIC 114-143-64, TF is zero at 184.9 deg and 358.1 deg.

However, the TF giving angle is represented on the θ' base. Therefore, if the crank angle is also changed to θ and is represented in θ', the second term $T_{CB}$ in expression (4) becomes zero at 180 deg and 360 deg. This means that the zero point of TF and the zero point of $T_{CB}$ become very close to each other. Therefore, the $T_L$ zero point, namely, the zero point of the secondary current is fixed to a specific value determined by the mechanical constant of the pump jack. That is, if the A' point is detected by the above-described method, a mechanical or magnetic sensor for detecting the crank angle becomes unnecessary.

The reference value for detecting pump off or no pump off based on the average value or effective value of the secondary current of the induction motor 1 for each cycle of the pump jack is possible by setting the current value corresponding to each speed of volume efficiency 63.7% in FIG. 6, for example, as previously described. The data as shown in FIG. 6 is stored in the secondary current reference generator 42 in FIG. 2 and is selected by the speed signal as shown in the figure.

As described so far, according to the first embodiment of the invention, without using an expensive dynagraph card system in the related art made up of a rod load sensor and a microcomputer, pump off control software is built in the inverter used for speed control of the pump jack, whereby pump off can be detected not only at low cost, but also precisely.

Since the pump jack speed is controlled, as pump off is detected, the pump jack speed can be lowered to a state in which no pump off exists, whereby continuous production in an oil well can be executed without imposing excessive load on the down-hole pump or the sucker rod system. That is, the effects of enhancing the productivity in an oil and improving safety of the facilities can be produced as compared with an oil well to which the pump jack in the related art driven at constant speed is applied.

The maximum speed of the down-hole pump can be preset corresponding to change in oil well circumstances accompanying the comparatively long time passage such as an increase in free gas or lowering of the oil well level, so that it is made possible to lower the possibility that pump off will occur, contributing to stable operation in an oil well accordingly.

Next, a second embodiment of the invention will be discussed with reference to FIGS. 1 and 10 to 16.

According to the second embodiment of the invention, it is not necessary to change the setup reference value as the pump jack speed is changed as compared with the described method of calculating the effective value or average value of secondary current instantaneous value of the motor in down stroke, comparing the effective value or average value with the reference value, and detecting pump off in the first embodiment.

The method according to the second embodiment is based on detection of the difference between the second current maximum value time and the setup reference time and thus is not related to the magnitude of the secondary current, so that it is hard to be affected by variations in down-hole pump load caused by change in the content of water and impurities in crude oil, and it is made possible to precisely detect pump off accordingly.

Further, operation processing becomes simple as compared with the method of the first embodiment, thus the method of the second embodiment has the advantage that a controller can be configured easily.

Figure 10:
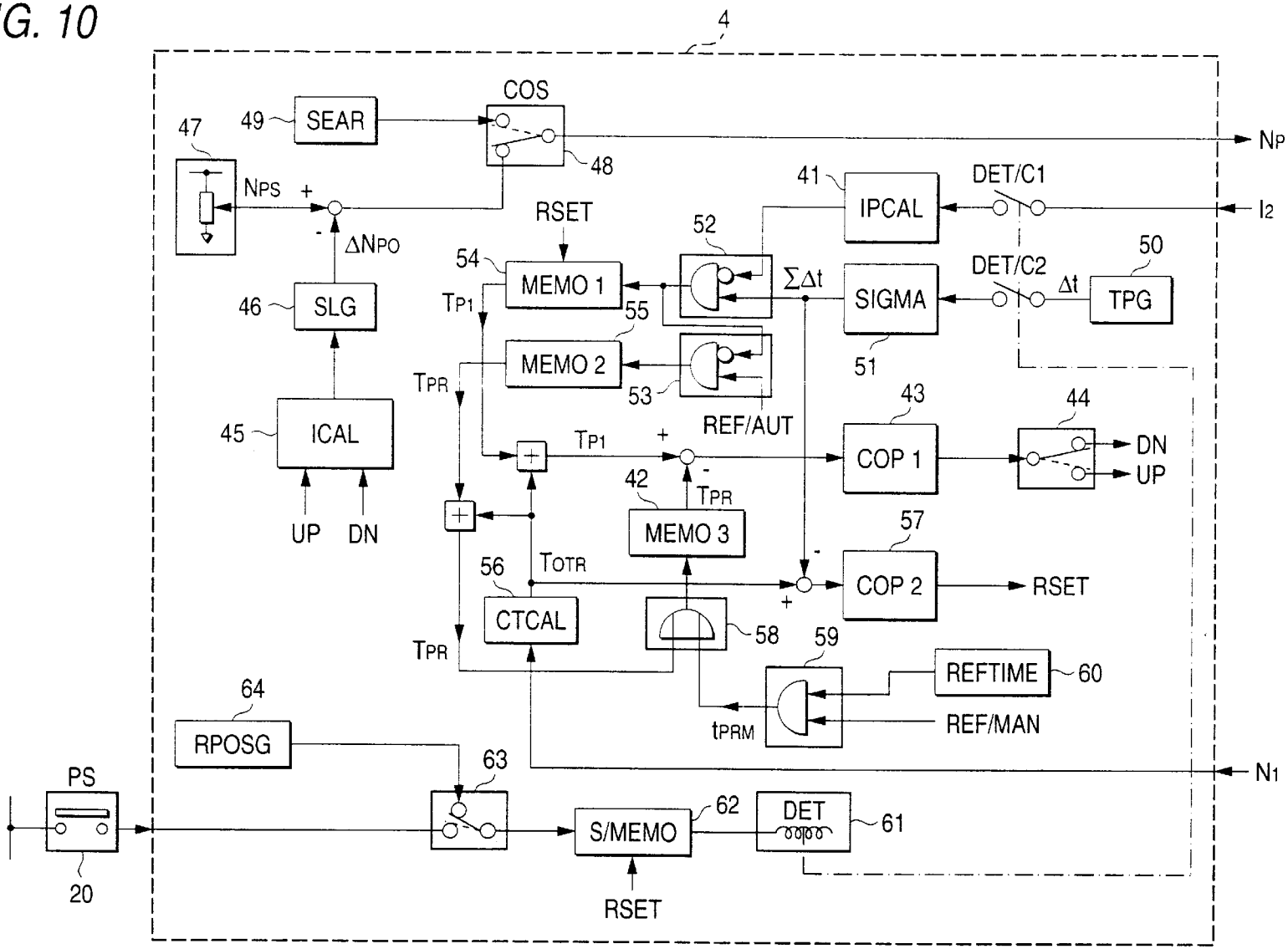
FIG. 10 is a drawing to show a basic control configuration example of pump off control of a method of the invention.

In FIG. 1, numeral 1 denotes a pump jack driving motor, numeral 2 denotes a speed detector connected directly to the motor, numeral 3 denotes a block diagram of control of a vector control inverter, and numeral 4 denotes a block diagram of pump off control of the second embodiment of the invention shown in FIG. 10. Numeral 31 denotes a linear accelerator of the inverter and the linear accelerator 31 converts Np, output of the pump-off controller 4, into speed reference of the induction motor 1, Ns at the acceleration rate which is set inside.

The actual speed is detected by the speed detector 2 and the speed reference Ns is compared with output of the speed detector 2, Ni, then a deviation therebetween is amplified by the speed regulator 32 and a secondary current reference $I_{2s}$ is output to the output side.

Motor current is detected by the current transformer 35 and only the secondary current component of the motor current is detected as $I_2$ by the vector operation section 36, then is compared with $I_{2s}$. A deviation in-between is amplified by the current regulator and the pulse width of voltage given to the motor is adjusted by the PWM controller 34, then secondary current required for driving a load is supplied.

Thus, the motor speed is automatically regulated so that the actual speed becomes almost equal to the speed reference. This means that the vector control inverter 3 in the figure has a known current minor loop. A control circuit of the flux component current of the induction motor is required for vector control, but is well known and is not directly related to the pump-off control of the invention and therefore is not shown in the figure for simplicity.

Next, a pump-off control method of the invention will be discussed with reference to FIG. 10.

In FIG. 10, an IPCAL block 41 calculates and detects the maximum value of the secondary current instantaneous value with respect to each down stroke time of a pump jack; when the secondary current $I_2$ in down stroke is detected and the secondary current arrives at the maximum value $I_{2P}$, the IPCAL block 41 gives a logical signal "1" to an AND logic element 52.

An SIGMA block 51 integrates time pulse Δt generated by a constant timing pulse generator 50 while a pump off detection relay DET 61 is on. While the AND logic element 52 is "1" the integration result of the SIGMA block 51 is written into a storage element 54 every secondary current sampling time. That is, if the logical signal "1" is given to the AND logic element 52 based on $I_{2P}$ detected by the IPCAL block 41, the value of the Δt time integrated to the point in time, namely, ΣΔt is stored in the storage element 54.

If ΣΔt at the down stroke time thus detected is assumed to be $T_{PI}$ (sec), this value is divided by output of a reference cycle time operation device 56, $T_{CTR}$ (sec), resulting in $t_{PI}$ (p.u.).

A storage element 42 stores setup reference time $t_{PR}$ (p.u.) to be compared with $t_{P1}$. In this case, $t_{PR}$ is manually set through an AND logic element 59 or is automatically set by setting the value $t_{PR}$ resulting from dividing the value given to the storage element 55 by $T_{CTR}$ through an AND logic element 53. That is, the actual secondary current maximum value time, $t_{PI}$ (p.u.), is compared with the setup reference time $t_{P1}$ (p.u.) set manually or automatically as described above, and the differenced in-between is input to a comparator 43.

The comparator 43 switches an output relay 44 as follows:

(1) If $t_{P1}>t_{PR}$, the output relay 44 is switched to "DN" position.

(2) In contrast, if $t_{P1}\leqq t_{PR}$, the output relay 44 is switched to "UP" position.

When $t_{P1}>t_{PR}$, it means that occurrence of pump off is detected as described later;

when $t_{P1}\leqq t_{PR}$, it means that reset of pump off is detected.

The ICAL block 45 has a function of controlling a pump off sequence and a function of issuing a speed reference for speeding down (DN) or up (UP) the speed of the pump jack in response to occurrence or reset of pump off. That is, DN or UP signal of the output relay 44 is counted and when the DN signal is detected twice or more successively, for example, a pump off sequence program in the ICAL block 45 is started.

When the pump off sequence program is started, the notch of the speed of the pump jack being operated is automatically determined, and a speed reference function generator 46 is controlled so that the pump jack speed reference becomes lower than the current speed by one notch.

In contrast, if the UP signal is detected twice or more successively, a pump off reset sequence program in the ICAL block 45 is started, and the speed command function generator 46 is controlled so that the pump jack speed becomes higher than the current operating speed by one notch contrary to the case of the pump off occurrence described above.

Numeral 47 denotes a main speed reference 47 of pump jack for setting the maximum speed corresponding to the current circumstances of the oil well, for example, like $N_{ps}$=100% speed or $N_{ps}$=80% speed.

Therefore, if pump off is detected during the operation at the setup speed, the speed is forcibly lowered by one notch with the speed reference function generator 46. That is, the pump jack speed becomes $N_{ps}-\Delta N_{p1}=N_p$ as $\Delta N_{pn}\rightarrow\Delta N_{p1}$, and a wait is made for the pump off condition to disappear. If pump off is detected successively, the speed is further lowered by one notch, for example, by $\Delta N_{p2}=2\times\Delta N_{p1}$.

However, when $N_{ps}-N_{pn}\leqq 0$, the pump jack is stopped. In this case, a pump stop and control change sequence program in the ICAL block 45 starts.

Numeral 49 denotes a speed reference device 49 for generating a crawling command to make a search for the presence or absence of a pump off condition. The program stops the pump off program and switches the speed command changer 48 to the speed command device 49 side.

Upon completion of the switching, a no pump off searching program in the ICAL block 45 starts. It is a control program for again forcibly starting the pump jack stopping with pump off in a given time, operating the pump jack at a crawling, and checking whether or not a pump off condition exists during the crawling operation; the program turns on/off the pump jack crawling operation and stop sequence of the pump jack and the crawling command of the speed command device 49 and checks whether or not pump off exists during the crawling operation.

If pump off reset is detected twice or more successively during the crawling operation, the no pump off searching program switches the speed reference changer 48 to the main speed set $N_{ps}$ side and again starts the pump off control sequence program. Thus, the pump jack is again controlled at the speed of $N_{ps}-\Delta N_{pn}=N_p$ and is automatically speeded up and is restored to the initial setup speed $N_{ps}$ while reset of the pump off condition is checked.

A reference cycle time operation device 56 reads pump jack speed $N_i$ and calculates ½ stroke time ($=T_s/2$) from the deceleration ratio set as a machine constant. It outputs the calculation value as reference cycle time $T_{CTR}$.

In the invention, to detect pump off, if the pump jack operates normally, it is necessary to store the secondary current maximum value time of the reference (when no pump off occurs) in a storage element MEMO 3 block 42 as the setup reference time. Thus, the manual setting mode and the automatically setting mode are provided as described above.

The case wherein the automatic setting mode is selected is as follows:

As the automatic setting is selected, the AND logic element 53 outputs "1" and while the AND logic element 52 is "1" $\Sigma\Delta t$ in the SIGMA block 51 is written into a storage element MEMO 2 block 55 every secondary current scan. Therefore, in the above-described method, at the instant at which the AND logic element 52 outputs "0" the elapsed time $\Sigma\Delta t$ at which the secondary current instantaneous value from the reference point reaches the maximum is stored in the storage element MEMO 2 block 55.

That is, if the operator checks that the pump jack operates in the no pump off state, starts the program of the mode, and operates the pump jack in one cycle, the time at which the secondary current instantaneous value from the reference point during the down cycle time reaches the maximum, namely, the setup reference time $T_{PR}$ (sec) can be provided as output of the storage element MEMO 2 block 55.

The time $T_{PR}$ is divided by $T_{CTR}$ and is set in the storage element MEMO 3 block 42 through an OR logic element 58. This value becomes setup reference time $t_{PR}$ (p.u.) for pump off detection considering some tolerance as described later. If the manual setting mode is used, reference time $t_{PRM}$ (p.u.) preset in a storage element 60 is set in the storage element MEMO 3 block 42 through the AND logic element 59 and the OR logic element 58.

To detect the time from the maximum value of the secondary current instantaneous value and the reference point, the detection start time and end time must be controlled. In the invention, the detection start time and end time are controlled using contacts DET/C1 and DET/C2 of the pump off detection relay DET 61 turned on and off according to output of a logic storage element 62. This logic storage element 62 is operated by a changeover switch 63 placed on the output side of the logic storage element 62 according to a signal of either a reference point signal generator 64 of software processing or a stroke position sensor 20 for detecting the stroke position of the pump jack. The stroke position sensor 20 is a mechanical, magnetic, or optical sensor for detecting the crank angle of the pump jack, for example, and when the stroke position of the pump jack comes to the up end, the signal of the stroke position sensor 20 turns on the logic storage element 62 and stores and turns on the pump off detection relay 61. The pump off detection relay 61 is turned on and detection of pump off is detected.

The storage signal of the position stored in the logic storage element 62 is reset when a comparator 57 issues an RSET pulse signal. The comparator 57 compares $T_{CTR}$ (sec) stored in the reference cycle time operation device 56 with $\Sigma\Delta t$ of output of the SIGMA block 51 and when $\Sigma\Delta t$ becomes equal to $T_{CTR}$, the comparator 57 issues an RSET pulse signal. As the RSET signal is issued, the contents of the storage element 54 are reset for detection of the secondary current maximum value time in the next down cycle.

That is, according to such a configuration and control, the secondary current maximum value time of the motor during the down stroke operation from the reference point can be detected for each down cycle using the pump off detection relay 61.

Numeral 64 denotes the reference point signal generator of software provided for the case where it is difficult to install the stroke position sensor 20 because of restrictions on the machine structure, etc., and the operation of the reference point signal generator 64 will be discussed in detail later.

As described so far, the invention provides the pump off detection method of adopting the principle of detecting the secondary current maximum value time of the motor during the down stroke from the reference point and comparing the value with the setup reference time when pump off does not occur, thereby detecting pump off or reset of pump off.

Figure 11:
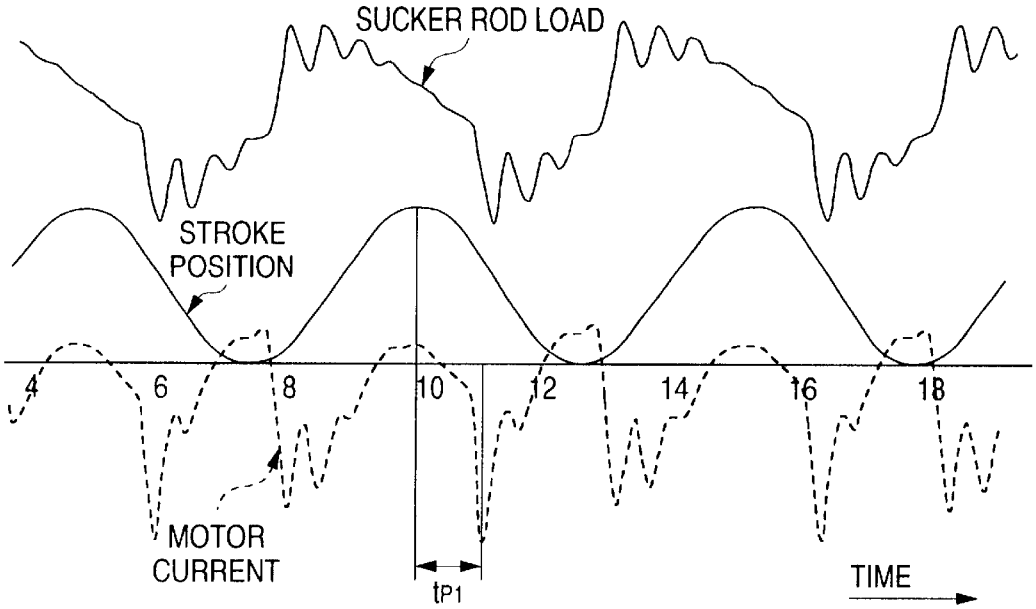
FIGS. 11(*a*)–(*b*), and 12–15 are schematic representations to describe the fact that pump off can be detected based on the difference between the secondary current maximum value time and reference time in the invention.
Figure 11:
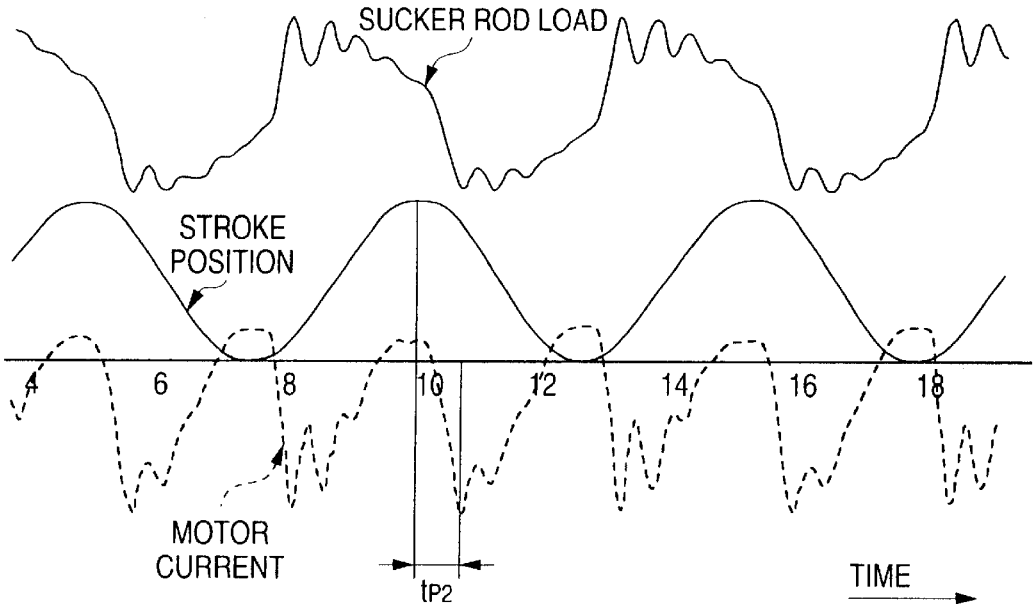

Therefore, in the invention, the fact that as a pump off condition occurs, the time at which the secondary current maximum value time of the motor reaches the maximum is made longer than that when the pump off condition does exist must be clarified. This will be discussed below:

When the rated stroke speed of the pump jack is 11.3 strokes/minute and the used pump unit is API C114-143-64 pump unit, FIG. 11 shows sucker rod torque and motor current found by computer simulation when the pump unit is operated at the rated speed.

The figure also shows pump jack stroke positions.

FIG. 11(*a*) shows the characteristic when pump off occurs, and FIG. 11(*b*) shows the characteristic when pump off does not occur.

By comparing FIGS. 11(*a*) and 11(*b*), it is seen that the time between the instant at which the stroke position is at the up stroke end and the instant at which the secondary current instantaneous value of the motor reaches the maximum, namely, the secondary current maximum value time becomes longer than that when pump off occurs.

The reason is that if the pump barrel of the down-hole pump is partially filled with free gas, etc., in the up stroke operation, when a transition is made from the up stroke end to the down stroke operation, if down stroke is started, a delivery valve does not immediately open because of the presence of the free gas.

This means that the delivery valve opens with a slight delay as compared with the case where the delivery valve opens in the normal operation with less or no free gas. As the free gas amount increases, opening of the delivery valve is delayed increasingly and a pump off state is entered. As the degree grows, the delivery valve is opened at a position away from the up end of pump jack stroke accordingly, causing overpressuring, which becomes a factor of a serious accident of the pump jack. If the delivery valve is opened with a delay from the highest position of pump jack stroke, the unloading time to the sucker rod system of the down-hole pump load is also delayed and the position of the peak value of the motor current is also delayed.

This invention applies the characteristic as the principle of pump off detection.

Figure 12:
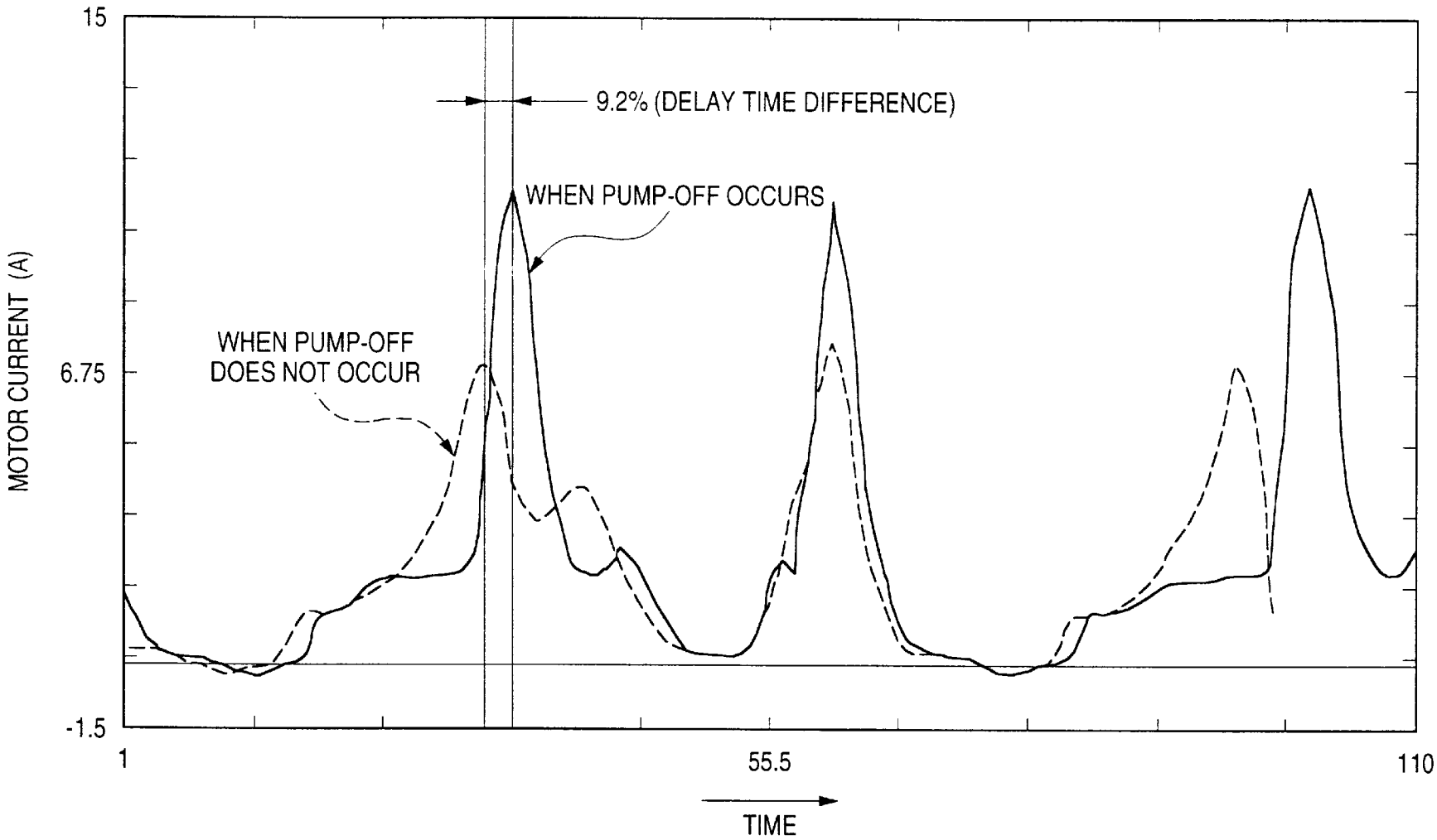

FIG. 12 shows the test result of pump off of the pump jack in a real machine.

In the example, oscillograms of the secondary currents of the motor when pump off occurs and when pump off does not occur at 80% stroke speed (100% stroke speed is 14 spm) are superimposed on each other. Seeing the figure, when pump off occurs, the secondary current maximum value time is delayed 9.2%. This means that the validity of the principle of the invention is proved. Here, the 100% time is 50% of the rated cycle time. The gradations of the X axis in FIG. 12 are shown with one unit time=80 ms.

The fact that the per unit delay time at the pump off time (=delay time/reference stroke time) is almost constant if the pump jack stroke speed is changed is confirmed on the same real machine. Table 1 provides an example of the measurement result when the pump off state is almost constant.

TABLE 1

| Secondary current maximum value time when pump off occurs (p.u.) | |
|---|---|
| Pump jack stroke speed | Per unit delay time |
| 80% | 0.552 p.u. |
| 64% | 0.550 p.u. |
| 44% | 0.470 p.u. |
| 40% | 0.469 p.u. |

In the example, it is seen that the secondary current maximum value time at 40% stroke speed (p.u.) is shortened than that during the 80% operation by 0.083 p.u.

Therefore, it is obvious that stricter pump off detection of the pump jack with a wide speed control range is possible if means for correcting the setup reference time (p.u.) in response to the pump jack speed setting is added.

The principle of pump off detection of the invention described so far is confirmed further by executing computer simulation.

Figure 13:
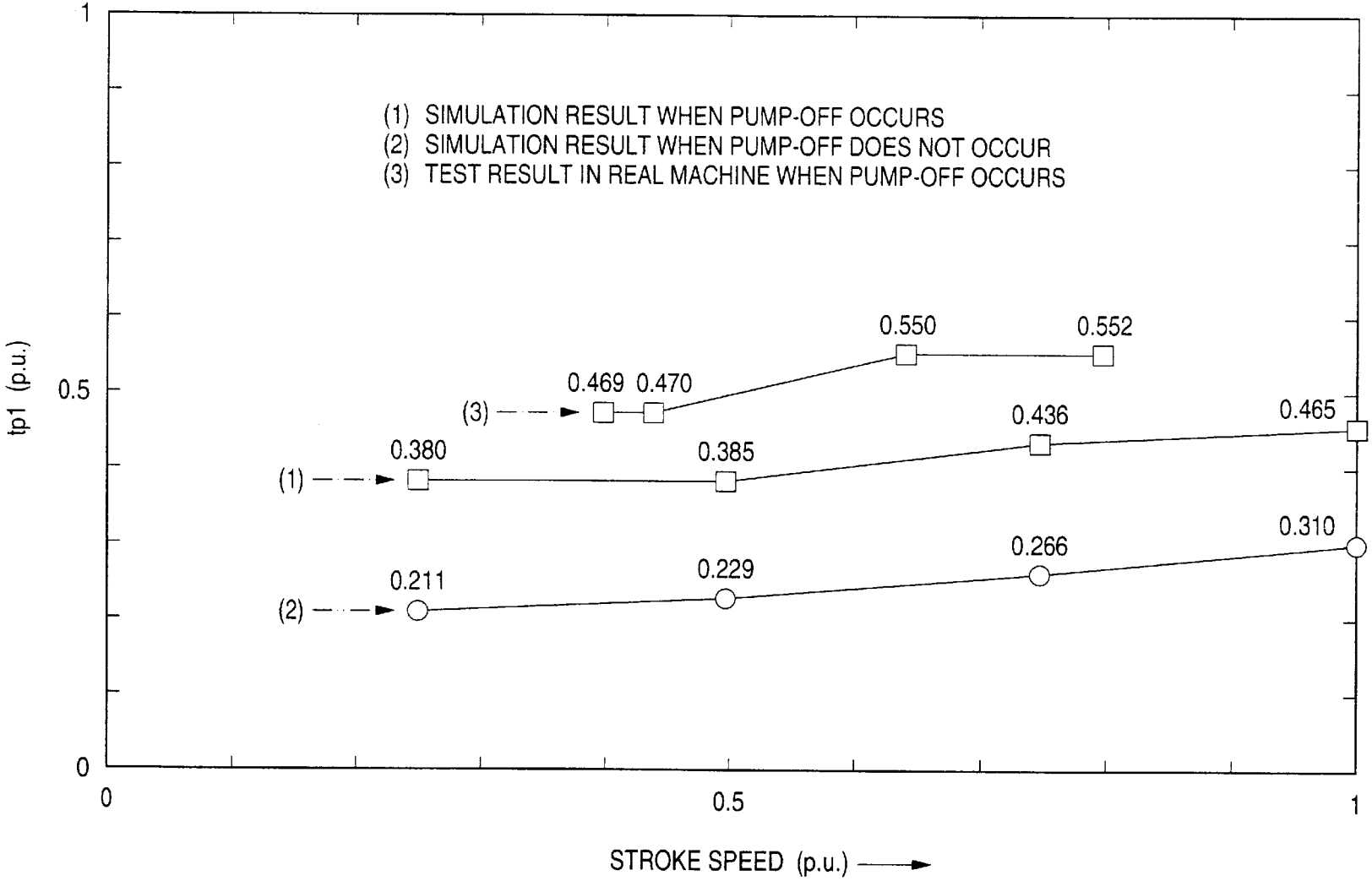

In FIG. 13, the secondary current maximum value time of the motor when pump off occurs and that in the normal operation are found in the above-described pump jack simulation model and the results are plotted with respect to the stroke speed.

The figure indicates that if the stroke speed is changed, the per unit delay time less varies and pump off can be detected reliably by the method of the invention.

In FIG. 13, the secondary current maximum value time when pump off occurs in the real machine listed in Table 1, although the pump jack model differs, is also plotted for comparison.

From the results, it can be concluded that the simulation results in FIG. 13 indicate the tendency close to the actual. It can also be acknowledged that the pump off detection method of the invention has a feature hard to receive the effect of stroke speed change.

The degree of pump off can be represented by a delay of the open time of the delivery valve of the down-hole pump at the down stroke start time because of the presence of free gas mixed into the pump barrel, etc, as described above. Therefore, the simulation is executed by representing the delay time as down stroke time ratio and changing the value in various ways. The result is shown in FIG. 14.

Figure 14:
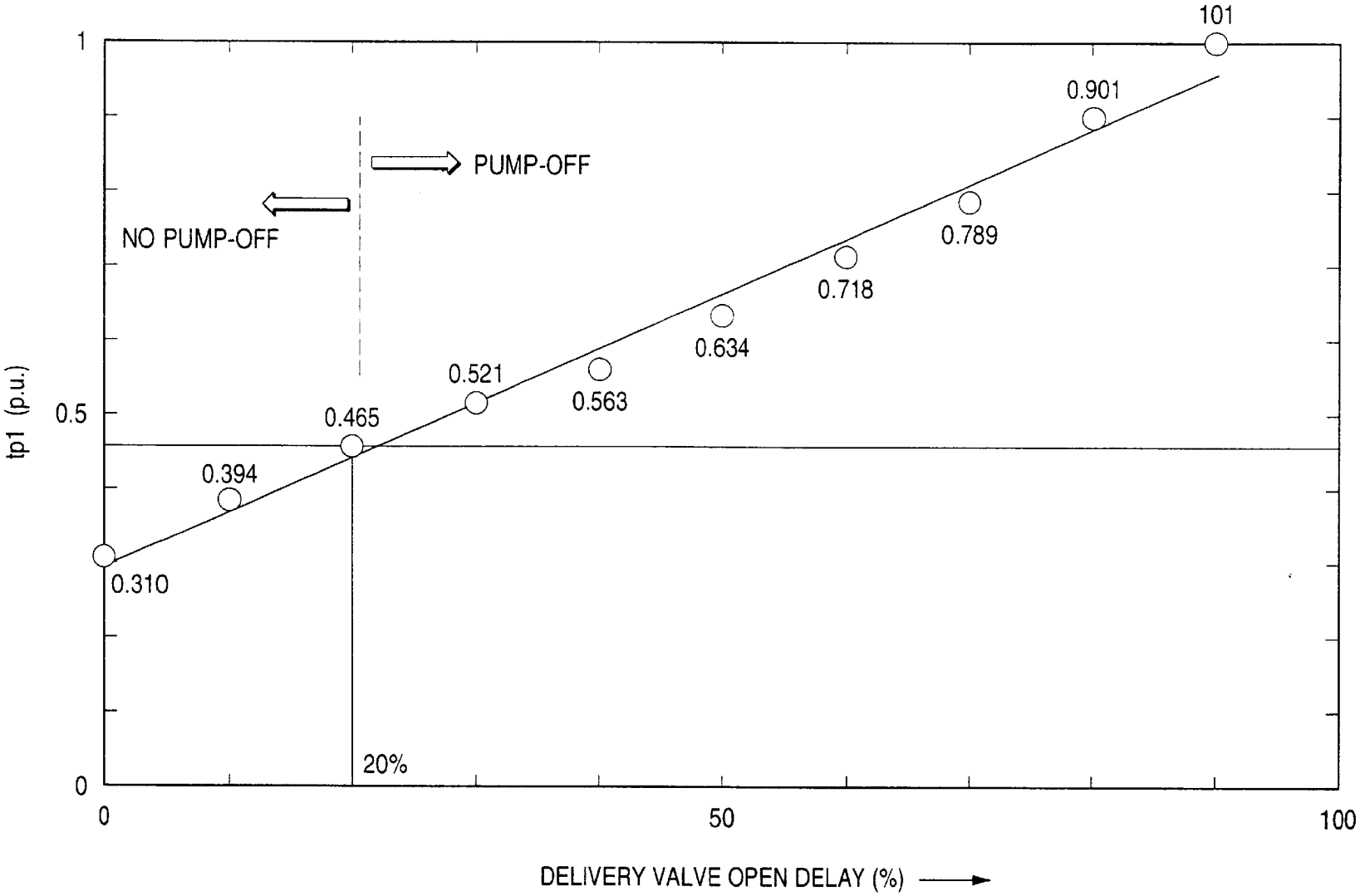

From FIG. 14, it is seen that if the pump off state is loose, pump off can be detected reliably according to the method of the invention.

As shown here, if $t_{P1}$ when a delay of the delivery valve is 20% is set as output $t_{PR}$ from the storage element MEMO 3 block 42 in FIG. 10 as the setup reference time considering variations in and tolerance of the secondary current maximum value time at the normal operation time, if delivery valve delay 20% or more is detected as pump off, a practical pump off control method can be formed.

If delivery valve delay less than 20% is detected as no pump off or pump off reset, pump off reset can be detected reliably.

The simulation result previously shown in FIG. 13 shows the case where the delivery valve delay is 20%.

Next, a control sequence for detecting the secondary current maximum value time will be discussed.

Figure 15:
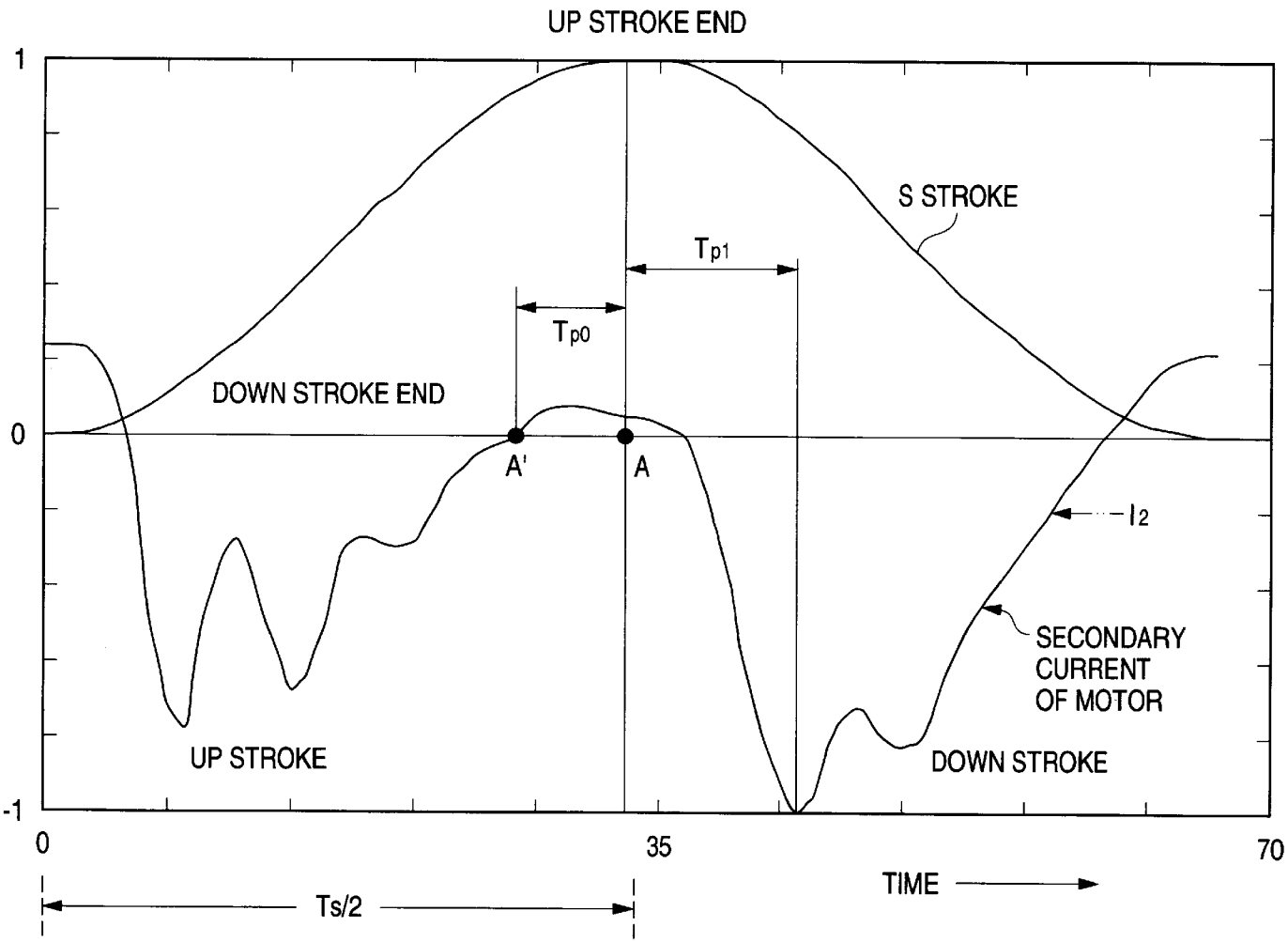

FIG. 15 is a schematic representation to show the relationship between motor current instantaneous values and pump jack stroke positions when the counter balance weight is set to a value close to the actual weight.

The case where the up stroke end in FIG. 15 is detected with the stroke position sensor 20 in FIG. 10 will be discussed. That is, when the pump jack stroke position comes to the up stroke end, the pump off detection relay 61 is turned on and inputting the instantaneous value of secondary current $I_2$ to secondary current maximum value detection circuit 41 is started.

At the same time, the SIGMA block 51 starts integrating Δt. Resultantly, the time of $T_{P1}$ in FIG. 15 is detected by the secondary current maximum value detection circuit 41, the SIGMA block, and the AND logic element 52 in FIG. 10 and is stored in the storage element (MEMO 1) 54.

Figure 16:
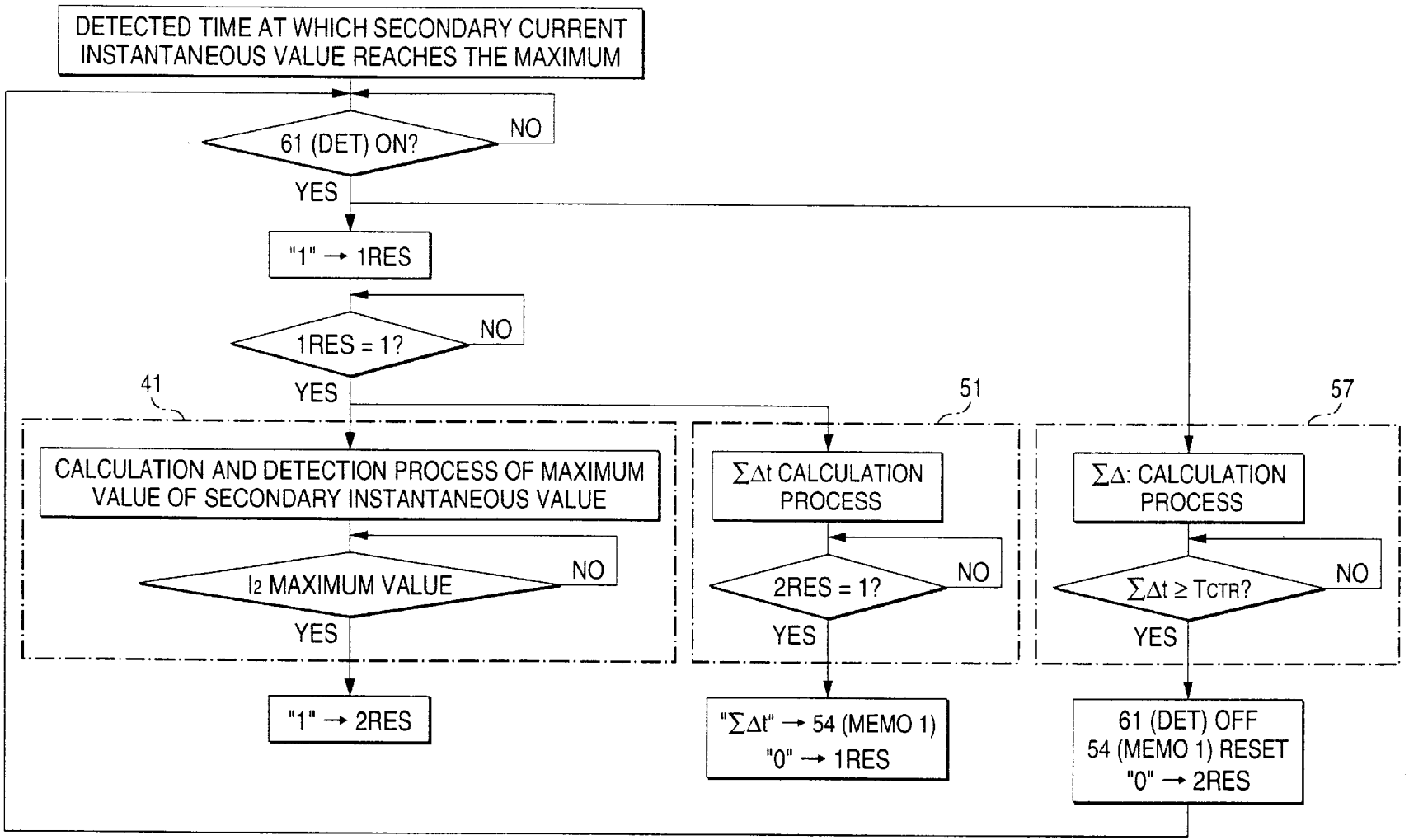
FIG. 16 shows a control flow for detecting the secondary current maximum value time according to the method of the invention.

FIG. 16 describes the operation as a control flow.

Supplemental remarks on software processing problems are as follows:

The secondary current maximum value time $T_{P1}$ requires detection of the maximum value of the secondary current instantaneous value before it is detected. Thus, in fact, it becomes a value delayed by the detecting and processing time of the maximum value of the secondary current instantaneous time. To avoid this problem, unlike the control flow in FIG. 16, the following known technique can also be applied: The secondary current instantaneous value every Δt time is stored in the secondary current maximum value detection circuit 41 as a table from turning on to off the pump off detection relay 61 and the secondary current maximum value time is detected from the stored table value using the time to the up stroke start in the next pump jack cycle from turning off the pump off detection relay 61. The motor current is not a smooth current waveform as shown in FIG. 15 and contains current ripples of the carrier frequency of an applied inverter. Therefore, the following known means can also be applied, of course: Means for inputting motor current every scan time smaller than the Δt time is provided and the values for each scan are compared with each other and if the current detection value monotonously increases $n_1$ times or more and then monotonously decreases $m_1$ times or more, the maximum value among the values is detected as the secondary current maximum value. ΣΔt corresponding to the secondary current value is detected from the table and the value is used as $T_{P1}$.

Next, the case where the up stroke end is detected by software processing in the RPOSG block 64 without using the stroke position sensor 20 in FIG. 10 will be discussed.

The RPOSG block 64 is a reference position signal generation circuit based on the fact that zero-cross point A' of motor current in FIG. 15 is determined by the net speed reducer shaft torque of the pump jack (=sucker rod torque−counter balance torque) and is fixed to a special crank angle determined by a machine constant.

That is, the A' point is detected as the zero-cross point of the motor current instantaneous value of up stroke and using this point as the reference, the time arriving at the up stroke end point is calculated and estimated as $T_{P0}$ in expression (1)

$$T_{P0}=(\Delta\theta/V\theta)\ (\text{sec}) \tag{5}$$

where $T_{P0}$: Estimated time from the zero-cross point of secondary current to the up stroke end, sec $\Delta\theta$: Phase difference angle between the crank angle matching the zero-cross point of secondary current and the crank angle of the up stroke end, deg: (Already known according to machine design specifications of pump jack)

$V\theta$: Average crank rotation speed=$360/T_S$=6.0×S, deg/sec $T_S$: Pump jack stroke time=60/S, sec S: Pump jack stroke speed, spm Therefore, if the A' point can be detected for each stoke cycle while the pump jack is operating, it can be estimated that the pump jack arrives at the up stroke end in $T_{P0}$ time after the point in time. Therefore, the 61 pump off detection relay in FIG. 10 is turned on in $T_{P0}$ time after the A' point is detected, whereby pump off detection start control is enabled without using the stroke position sensor 20. The A' point is a point of rod torque zero before the up stroke end and must be distinguished from the rod torque zero point around the down stroke end. Thus, in the invention, when up stroke is started, the operator enters a signal of "up stroke start" and logical operation on this storage signal, which will be hereinafter referred to as teach-in signal, and the magnitude of secondary current is applied. That is, to detect the fact that the pump jack operates as up stroke, new secondary current detection means for detecting the fact that the motor current becomes 50% or more, and the signal and the above-mentioned teach-in signal become effective at the same time, whereby the fact that the pump jack is operating as up stroke reliably is detected and stored. The zero point when the secondary current makes a transition to zero, minus from plus during the up stroke thus stored is the above-mentioned A' point and can be easily detected by performing well-known logical operation.

In the block diagram of 64 in FIG. 10, signal indication of input of secondary current, input of the teach-in signal, etc., as described above is required, but is not shown for simplicity.

The fact that the zero-cross A' point of the secondary current mentioned above is determined by the mechanical constant of the pump jack is already described in the first embodiment.

Industrial Applicability

The new pump off control method according to the invention, whereby without using an expensive dynagraph card system made up of a rod load sensor and a microcomputer, pump off control software is incorporated in the vector control inverter used for speed control of the pump jack, thus pump off can be detected not only at low cost, but also precisely.

In addition, since the pump jack speed is controlled, as pump off is detected, the pump jack speed can be lowered to a state in which no pump off exists, so that continuous production in an oil well can be executed without imposing excessive load on the down-hole pump or the sucker rod system.

What is claimed is:

1. A system for pump off control of a pump jack drive system of induction motor drive comprising:

means for detecting speed of the induction motor and an instantaneous value of secondary current of the induction motor;

means for detecting down stroke time in every cycle of the pump jack;

means for detecting each maximum value of the secondary current instantaneous values in each down stroke time of the secondary current;

means for detecting and storing a time value from each down stroke reference point to said each maximum value of the secondary current instantaneous values; and means for setting a reference time value to be compared with the detected and stored time value, wherein the system is capable of comparing the detected and stored time value with the reference time value after the down stroke end every cycle and the system is further capable of detecting an occurrence of a pump off condition as a case where the time at which the instantaneous value of the secondary current reaches the maximum value lags behind the setup reference value.

2. The system as claimed in claim 1 wherein said reference time value represents a lag time from a beginning to the maximum value of the secondary current being set based on a pump jack stroke time ratio so that pump off can be detected without being affected by change in pump jack speed setting.

3. The system as claimed in claim 1 or 2 wherein when a pump off condition is detected once or successively more than once after the down stroke end, control is performed so as to lower pump jack speed by a preset speed amount, wherein the system is capable of detecting a time value at which the actual secondary current instantaneous value reaches the maximum value from the reference point at the speed and further capable of comparing said time value with the setup reference time, wherein if the secondary current instantaneous value maximum value time is greater than the setup reference value, the system is determined such that the pump off condition is still existing at the lowered speed, wherein if the operation is detected once or successively more than once, the system is capable of performing control to further lower the pump jack speed by the preset speed amount, and wherein the system is capable of performing control to lower the pump jack speed gradually in sequence so long as pump off is detected.

4. The system as claimed in any one of claims 1 or 2 wherein the system is capable of detecting pump off condition and lowering speed by the preset speed amount, wherein if pump off condition is not detected once or successively more than once in a state in which the pump jack operates at the lowered speed, the system is capable of detecting pump off reset, wherein the speed is raised by the preset speed amount, wherein the time value at which the actual secondary current instantaneous value reaches the maximum value at the raised speed is detected and the time value is compared with the reference time, wherein if the time is less than the reference time value the pump off condition being still reset at the raised speed is detected, wherein if the operation is detected once or successively more than once, control is performed so as to further raise the pump jack speed by the preset speed amount, and wherein control is performed so as to raise the pump jack speed gradually in sequence to the speed at which pump off condition is detected.

5. A pump off control method of a pump jack drive system adapted to control speed of an induction motor for driving a pump jack, said pump off control method comprising the steps of:

a) detecting the speed of the induction motor and an instantaneous value of secondary current of the induction motor;

b) detecting down stroke time in every cycle of the pump jack;

c) calculating an average value of instantaneous values of the secondary current of the induction motor in the down stroke time in said every cycle;

d) setting an average value reference of the secondary current of the induction motor to be compared with calculated average value of the instantaneous values of the secondary current of the induction motor;

e) comparing the calculated average value of the instantaneous values of the secondary current with the average value reference after the down stroke end in each cycle, and f) detecting occurrence of pump off if the calculated average value of the instantaneous values is greater than the average value reference.

6. The pump off control method as claimed in claim 5 wherein the reference value is set based on a pump speed of the pump jack.

7. The pump off control method as claimed in claim 5 or 6 wherein when a pump off condition is detected successively more than once after the down stroke end, the method further comprises:

g) performing control to lower pump jack speed to a lowered speed by a preset speed amount;

h) repeating said steps c–e;

i) repeating said steps g–h as long as pump off is detected.

8. The pump off control method as claimed in any one of claims 5 or 6 wherein pump off condition is detected and speed is lowered by a preset speed amount, wherein if pump off condition is not detected successively more than once in a state in which the pump jack operates at the new lowered speed, the method further comprises:

g) performing control to raise pump jack speed amount to a raised speed by the preset speed amount;

h) repeating said steps c–e;

i) repeating said steps g–h as long as pump off is detected.

9. The pump off control method as claimed in claim 5 wherein the average value is one of an arithmetic mean and a root mean square value.

* * * * *